US005782192A

United States Patent [19]

Kear et al.

[11] Patent Number: 5,782,192

[45] Date of Patent: Jul. 21, 1998

[54] AUTOMATED SEWING SYSTEM

[75] Inventors: Jerry S. Kear; Larry C. Dulaney, both of Knoxville; Douglas H. Capps, Powell, all of Tenn.

[73] Assignee: VMW Automated Apparel Equip., Knoxville, Tenn.

[21] Appl. No.: 751,811

[22] Filed: Nov. 19, 1996

[51] Int. Cl.[6] ..... D05B 21/00

[52] U.S. Cl. ..... 112/470.05; 112/142; 112/153; 112/470.36; 112/DIG. 1; 112/287; 112/272; 112/273

[58] Field of Search ..... 112/470.02, 470.05, 112/475.02, 141, 142, 147, 153, 470.36, DIG. 1, 287, 272, 273, 302, 304, 322

[56] References Cited

U.S. PATENT DOCUMENTS

| | | | |
|---|---|---|---|
| 3,344,759 | 10/1967 | Palmer | 112/2 |
| 3,590,758 | 7/1971 | Hughes | 112/322 X |
| 4,095,537 | 6/1978 | Silverman et al. | 112/141 X |
| 4,395,963 | 8/1983 | Diacont, Jr. et al. | 112/142 X |
| 4,590,871 | 5/1986 | Granville | 112/142 |
| 4,660,486 | 4/1987 | Arbter | 112/304 X |
| 4,841,890 | 6/1989 | Tancs | 112/273 |
| 4,865,309 | 9/1989 | Beasock et al. . | |
| 5,010,833 | 4/1991 | Spencer, III et al. | 112/153 X |
| 5,031,552 | 7/1991 | Hansberry | 112/153 X |
| 5,033,399 | 7/1991 | Miyachi et al. | 112/142 |
| 5,107,780 | 4/1992 | Braun | 112/314 |
| 5,259,329 | 11/1993 | Reedman et al. . | |
| 5,290,027 | 3/1994 | Clanton et al. . | |
| 5,415,118 | 5/1995 | Adamski, Jr. et al. . | |
| 5,417,174 | 5/1995 | Allison et al. . | |
| 5,460,109 | 10/1995 | Adamski, Jr. et al. | 112/470.02 X |
| 5,636,582 | 6/1997 | Ferguson et al. | 112/142 |

*Primary Examiner*—Paul C. Lewis
*Attorney, Agent, or Firm*—Pitts & Brittian, P.C.

[57] ABSTRACT

An automated sewing system including a loading unit, a seam folding unit and a sewing unit which are mounted on a support table. The automated sewing system further includes a control system for monitoring and controlling the loading unit, seam folding unit and sewing unit. The loading unit includes a loading assembly for receiving the two articles and a conveying assembly for advancing the two articles to the seam folding unit. The seam folding unit includes a seam folder for receiving the edges of the articles therethrough to interlock the edges of the articles and a conveying assembly for advancing the two articles to the sewing unit. The sewing unit includes a sewing machine which sews the two articles together at the seam to produce a sewn product.

24 Claims, 21 Drawing Sheets

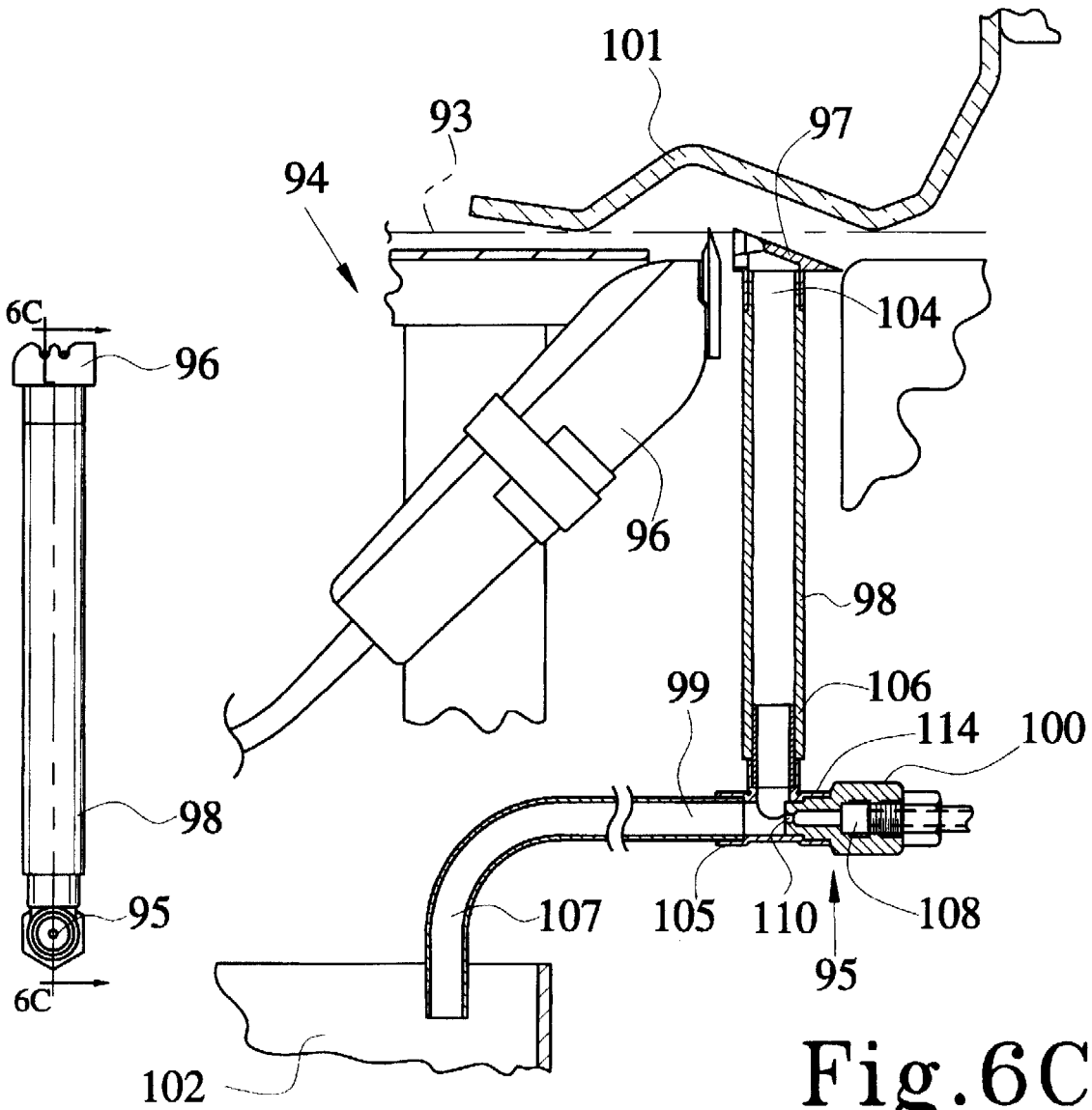
Fig.6C
Fig.6B
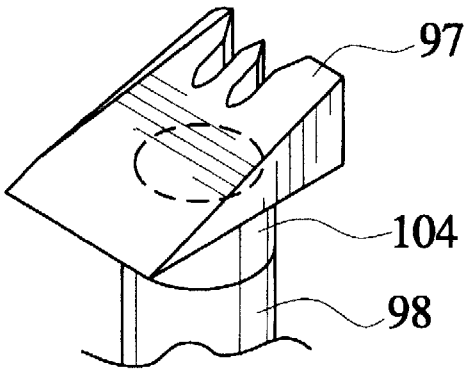
Fig.6A

140

AUTOMATED SEWING SYSTEM

TECHNICAL FIELD

This invention relates to the field of sewing machines and more specifically to a system for aligning two articles to be sewn together and feeding them through a sewing machine.

BACKGROUND ART

The demand for the development of automated sewing systems for sewing a variety of articles together has increased considerably in recent years for several reasons. It is difficult to find individuals who are willing to work in sewing factories at a piece meal rate. Further, difficult seams and manipulations can cause the employees hands to become fatigued. Moreover, the cost of employing capable employees is rising while the profit for the clothing sold by manufacturers continues to be competitively low.

Several devices have been produced to automate the sewing process. Typical of the art are those devices disclosed in the following U.S. Patents:

| Pat. No. | Inventor(s) | Issue Date |
|---|---|---|
| 3,344,759 | G. W. Palmer | October 3, 1967 |
| 4,865,309 | Beasock et al. | September 12, 1989 |
| 5,107,780 | H. Braun | April 28, 1992 |
| 5,259,329 | Reedman et al. | November 9, 1993 |
| 5,290,027 | Clanton et al. | March 1, 1994 |
| 5,415,118 | Adamski, Jr. et al. | May 16, 1995 |
| 5,417,174 | Allison et al. | May 23, 1995 |

The '309, '780, '027 and '118 patents teach apparatuses for aligning and/or positioning articles to be sewn together. The '309 patent is directed to a method and apparatus for aligning work pieces of variable lengths. The '780 patent teaches a device for correcting misalignment of patterns on fabric parts to be sewn together. The '027 patent teaches a complicated device for positioning an article in a predetermined position. The '118 patent teaches an alignment device including three wheel assemblies which move in skew angles from the traveling direction of the articles to be sewn to correctly position each article.

The '329 patent teaches an automatic machine system which includes a work support means for moving a workpiece via a cooperating clamping and feeding means in a first direction. Both the work support and the clamping and feeding means is supported on a carriage which moves in a direction perpendicular to the first direction. A camera is used to determine the peripheral outline of a workpiece. This information is fed into a computer to access appropriate stitch patterns. The sewing system is complicated in an attempt to accommodate a variety of workpieces. Further, the sewing system does not include a means for folding a seam to interlock the edges of the workpieces to be sewn. Moreover, the system does not include a means for differentially feeding one article with respect to the other to accommodate any discrepancies in length. Also, the system does not include a means for cutting and collecting waste thread.

Therefore, it is an object of the present invention to provide an automated sewing system which includes a loading unit to assure that the articles to be sewn are properly aligned.

It is another object of the present invention to provide an automated sewing system which operates in an alternating manner to produce right and left rear portions of jeans.

Further, it is an object of the present invention to provide an automated sewing system which includes a seam folding unit for interlocking the edges of the articles to form a seam.

It is yet another object of the present invention to provide an automated sewing system which includes a means for differentially feeding one of the articles to accommodate for a difference in length relative to the remaining article.

It is another object of the present invention to provide an automated sewing system which includes a sewing unit with a waste thread collector.

SUMMARY

Other objects and advantages will be accomplished by the present invention which provides an automated sewing system. The automated sewing system of the present invention includes a loading unit, a seam folding unit and a sewing unit which are mounted on a support table. The automated sewing system further includes a control system for monitoring and controlling the loading unit, seam folding unit and sewing unit. The loading unit includes a loading assembly for receiving the two articles and a conveying assembly for advancing the two articles to the seam folding unit. The seam folding unit includes a seam folder for receiving the edges of the articles therethrough to interlock the edges of the articles and a conveying assembly for advancing the two articles to the sewing unit. The sewing unit includes a sewing machine which sews the two articles together at the seam to produce a sewn product.

The control system includes loading sensors for assuring that the articles are loaded in the loading unit are loaded properly. Further, the control system includes a means for aligning the articles once loaded in the loading unit. The control system also includes a means for advancing the articles through the sewing unit at a differential speed. Moreover, the control system controls the operation of the sewing machine.

BRIEF DESCRIPTION OF THE DRAWINGS

The above mentioned features of the invention will become more clearly understood from the following detailed description of the invention read together with the drawings in which:

FIG. 6A is a perspective view of the guide of the waste thread collector;

FIG. 6B is a end view of the waste thread collector;

FIG. 6C is a sectional view of the waste thread collector taken along line 6C—6C of FIG. 6B;

FIGS. 8A–8J are a flow diagram of the operation of the automated sewing system;

DESCRIPTION OF PREFERRED EMBODIMENTS

An automated sewing system incorporating various features of the present invention is illustrated generally at 10 in the figures. The automated sewing system 10 is designed to align two articles to be sewn together and feed the articles to the sewing machine for sewing. Moreover, in the preferred embodiment, the automated sewing system 10 includes a seam folder. The automated sewing system illustrated in the Figures is specifically designed for sewing the yolk or riser and a panel of a rear portion of a pant leg of jeans together. More specifically, the system is designed for sewing both the right and left rear portions of pant legs of jeans. The disclosure is not intended to limit the automated sewing system to the above-identified use but serves only as an example.

Figure 1:
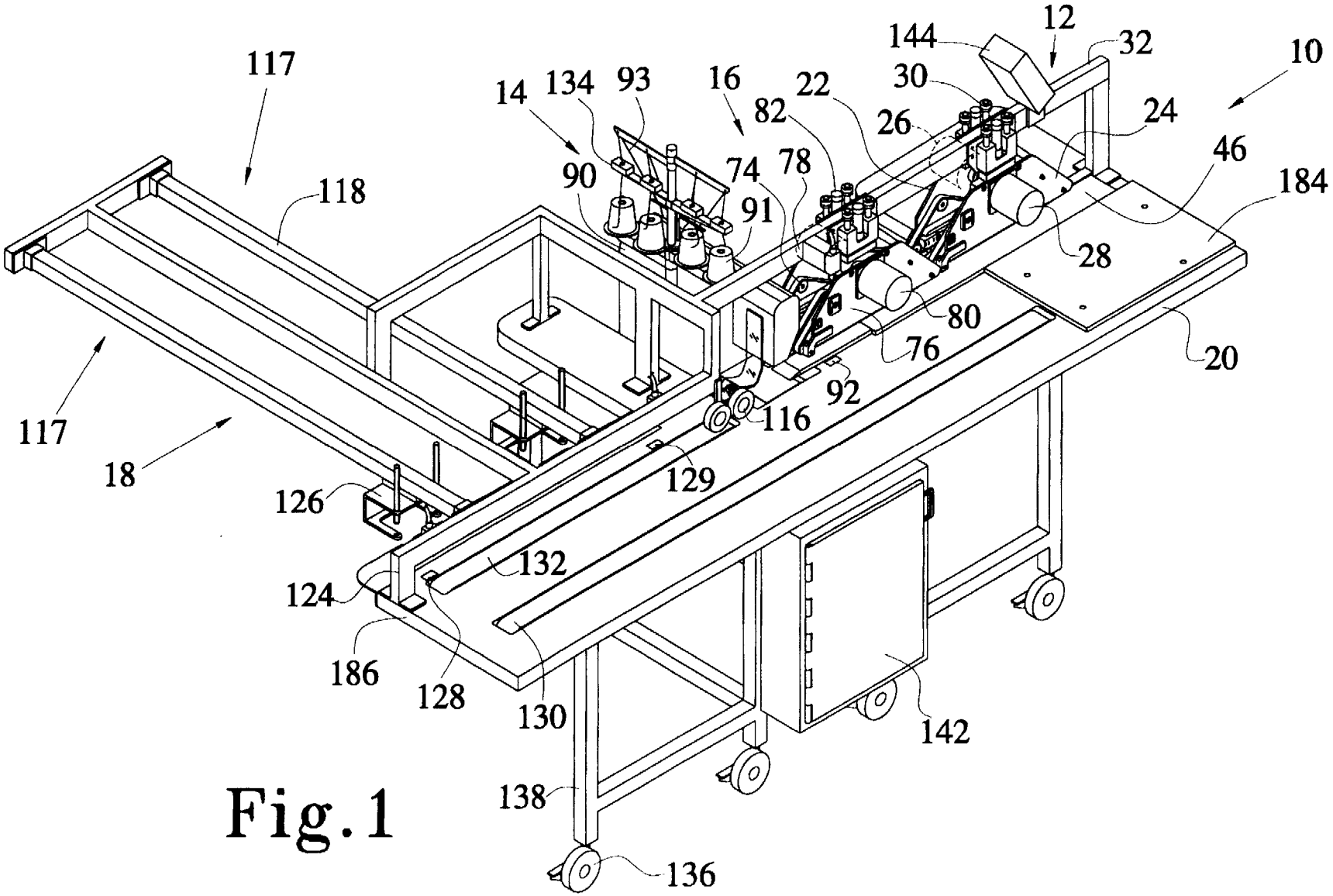
FIG. 1 is a perspective view of the automated sewing system constructed in accordance with several features of the present invention.
Figure 2:
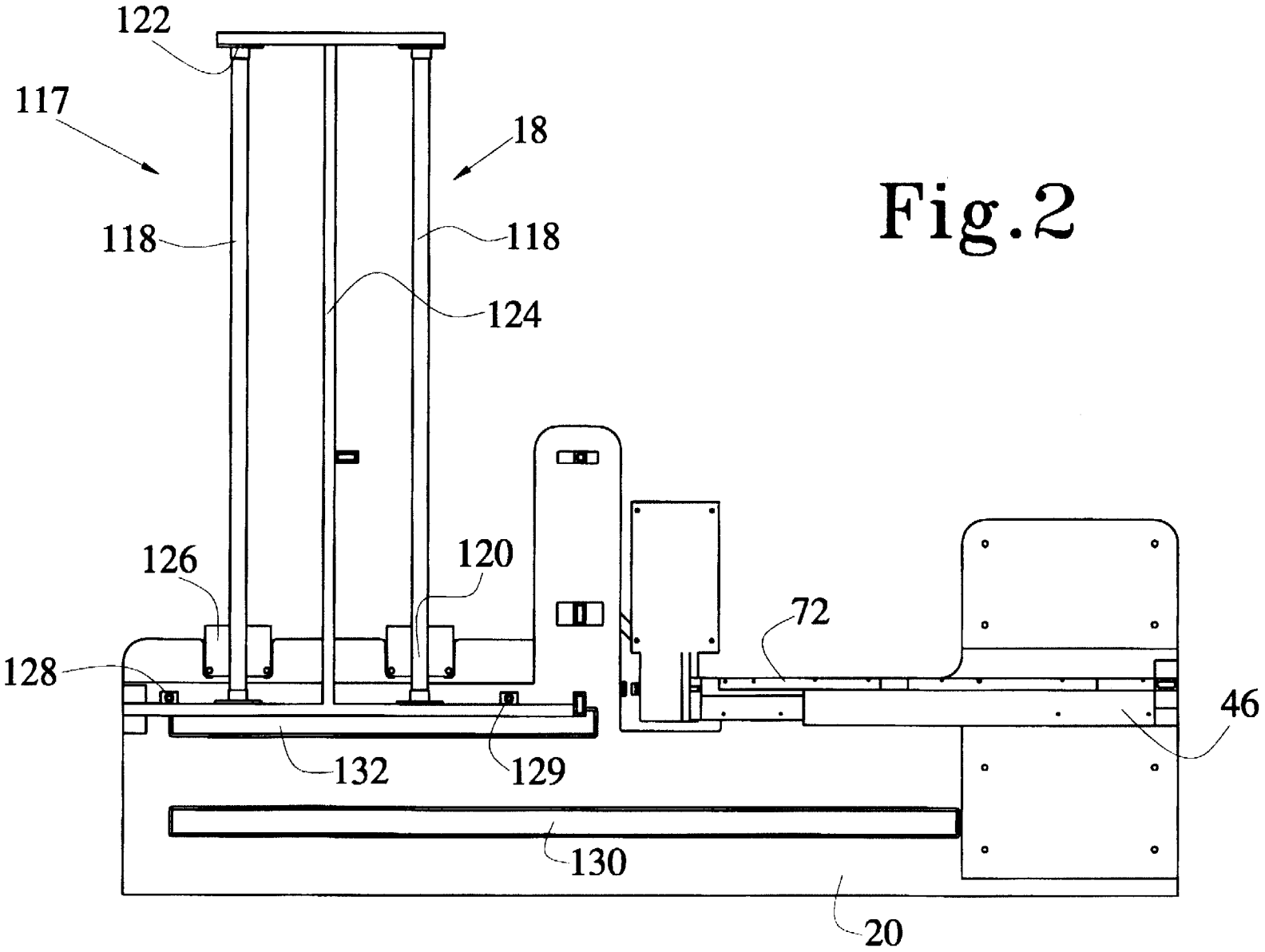
FIG. 2 is a top view of the automated sewing system of FIG. 1.

The automated sewing system 10 of the present invention is generally comprised of a loading unit 12, a seam folding unit and a sewing unit 14 supported on a support table 20, as shown in FIG. 1. FIG. 2 illustrates a top view of the automated sewing system 10. The loading unit 12 is designed to assure that the two articles to be sewn together are loaded properly. The loading unit 12 is positioned proximate the first end 184 of the support table 20. The loading unit 12 feeds the articles to the seam folding unit 16 for folding a seam with the edges of the articles. The seam folding unit 16 feeds the articles to the sewing unit 14 for sewing the seam. Moreover, in the preferred embodiment, the automated sewing system 10 includes a stacker unit 18 positioned proximate the second end of the support table 186 for stacking the sewn article.

Referring to FIG. 1, the loading unit 12 generally includes a loading assembly 46 for loading and supporting the articles to be sewn, a loading unit riser conveying belt assembly 22 and a loading unit panel conveying belt assembly 24 for clamping down and securely holding the riser and panel, respectively, in position once positioned properly and a loading unit riser motor 26 and a loading unit panel motor 28 for driving the respective conveying belt assemblies 22, 24, respectively. The lowering and raising of each conveying belt assembly 22, 24 is independently controlled via pneumatic cylinders 30 secured to an upper support structure 32 secured to the support table 20. In the preferred embodiment, the loading unit 12 further includes riser and panel loading sensors 34, 36, riser and panel leading edge sensors 38, 42 and riser and panel trailing edge sensors 40, 44, as shown in FIG. 3A.

Figure 3A:
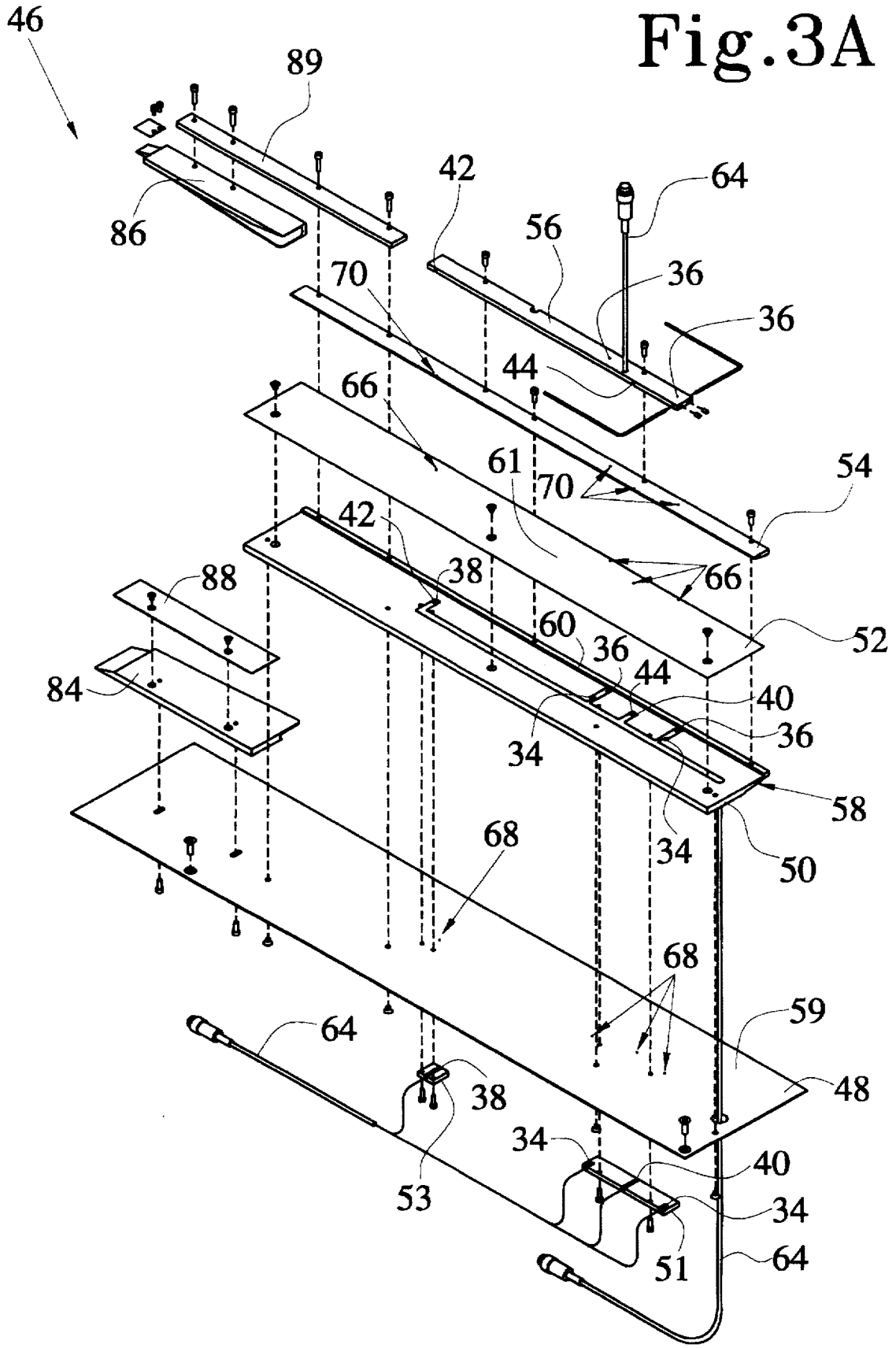
FIG. 3A illustrates an exploded view of the loading assembly.
Figure 3B:
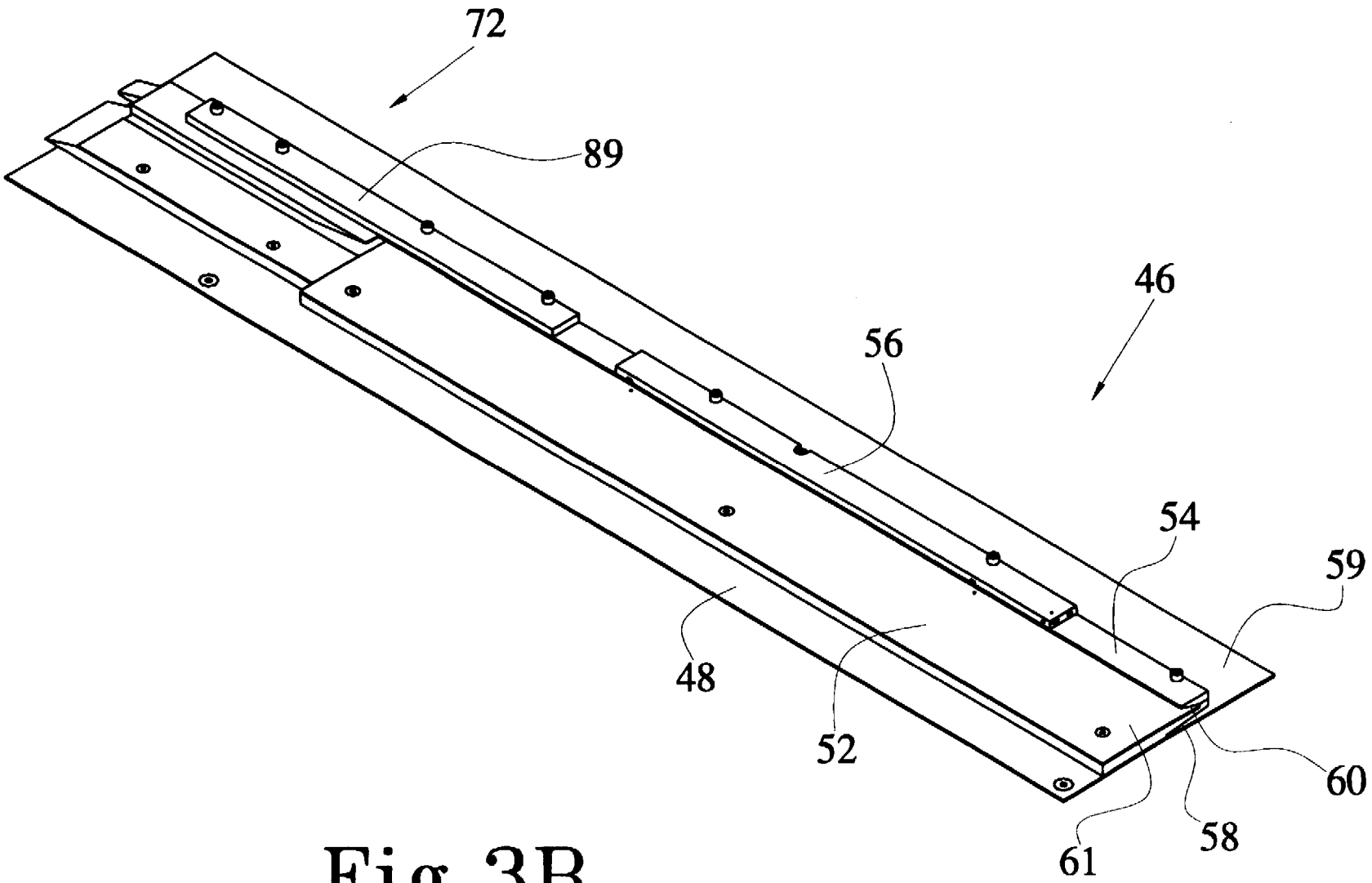
FIG. 3B is a perspective view of the loading assembly.

FIG. 3A illustrates an exploded view of the loading assembly 46 of the preferred embodiment and FIG. 3B illustrates the loading assembly 46 in a fully constructed manner. The loading assembly 46 includes a sensor bar 51, a sensor tab 53, a mounting plate 48, a bottom sensor plate 50, a cover plate 52, a cap bar 54 and a top sensor plate 56. The bottom sensor plate 50 is secured to the mounting plate 48. The bottom sensor plate 50 defines a panel edge notch 60 which extends lengthwise on the top side thereof and a riser edge notch 58 which extends lengthwise on the under side of thereof. The cover plate 52 provides a panel edge support surface 61 extending perpendicular to the panel edge notch 60. The cover plate 52 is secured to the top of the bottom sensor plate 50. The cap bar 54 is also secured to the top of the bottom sensor plate 50. The mounting plate 48 provides a riser edge support surface 59 extending perpendicular to the riser edge notch 58. The top sensor plate 56 is secured to the top of the cap bar 54. In the preferred embodiment, the riser edge notch 58 and the panel edge notch 60 are configured such that riser and panel inserted therein overlap each other approximately 1¼ inches, as shown most clearly at the first end of the loading assembly in FIG. 3B.

In the preferred embodiment, the loading sensors 34, 36, trailing edge sensors 40, 44 and leading edge sensors 38, 42 are mounted in the loading assembly 46. Moreover, in the preferred embodiment, all of the sensors are conventional light sensors which are comprised of a light source which provides a light beam and a detector for receiving the light beam. A power line and a data line are fed to each sensor and the power lines and data lines are encased in a cable 64, as shown in FIG. 3A. Each power line powers each sensor. Each data line is in communication with each detector for delivering the information the detector detects to a control system.

The riser loading sensors 34, the riser trailing edge sensor 40 and the riser leading edge sensor 38 are positioned proximate the riser edge notch 58, as shown in FIG. 3. It will be noted that in the preferred embodiment there are two riser loading sensors 34, which are preferably positioned approximately 1/16 of an inch from the edge of the riser edge notch 58. The receivers for each of the riser sensors 34, 38, 40 are mounted in the bottom sensor plate 50. The light sources for each of the riser sensors 34, 38, 40 are mounted in the sensor bar 51 and the sensor tab 53. The mounting plate 48 defines openings 68 which are aligned to permit the passage of the light beams from each light source therethrough. It will be noted that, in the preferred embodiment, the light sources are directed upward and the receivers are positioned above their respective light sources such that any overhead lighting does not interfere with the sensors.

The panel loading sensors 36, the panel trailing edge sensor 44 and the panel leading edge sensor 42 are located proximate the panel edge notch 60, as shown in FIG. 3A. It will be noted that, in the preferred embodiment, there are two panel loading sensors 36 positioned approximately 1/16 of an inch from the notch 60 of the bottom sensor plate 50. The light sources for each of the panel sensors 36, 42, 44 are mounted in the bottom sensor plate 50. The receivers for each of the panel sensors 36, 42, 44 are mounted in the top sensor plate 56. The cover plate 52 and the cap bar 54 define openings 66, 70 for each of the light sources such that the light beam passes therethrough.

As shown in FIG. 1, the seam folding unit 16 is generally comprised of a seam folder 72, a folding unit riser conveying belt assembly 74 and a folding unit panel conveying belt assembly 76 driven by a folding unit riser motor 78 and a folding unit panel motor 80, respectively. Each of the riser and panel conveying belt assemblies 74, 76 is supported on the upper support structure 32 via pneumatic cylinders 82 which control the raising and lowering of the conveying belt assemblies 74, 76. In the preferred embodiment, the folding unit panel conveying belt assembly 76 includes two spaced belts to better grip the panel and the pocket which is usually secured thereto.

The seam folder 72 is mounted to the second end of the loading assembly 46 of the loading unit 12, as shown in FIGS. 3A and 3B. An exploded view of the seam folder is shown in FIG. 3A and, a top view of the seam folder 72 is shown in FIG. 4. The seam folder 72 includes a bottom folder 84, a top folder 86, a wear plate 88 secured therebetween. The bottom folder 84 and the wear plate 88 are secured to the mounting plate 48 of the loading assembly 46 and the top folder 86 is secured to a mounting bar 89 which is secured to the cap bar 54 of the loading assembly 46.

Figure 4A:
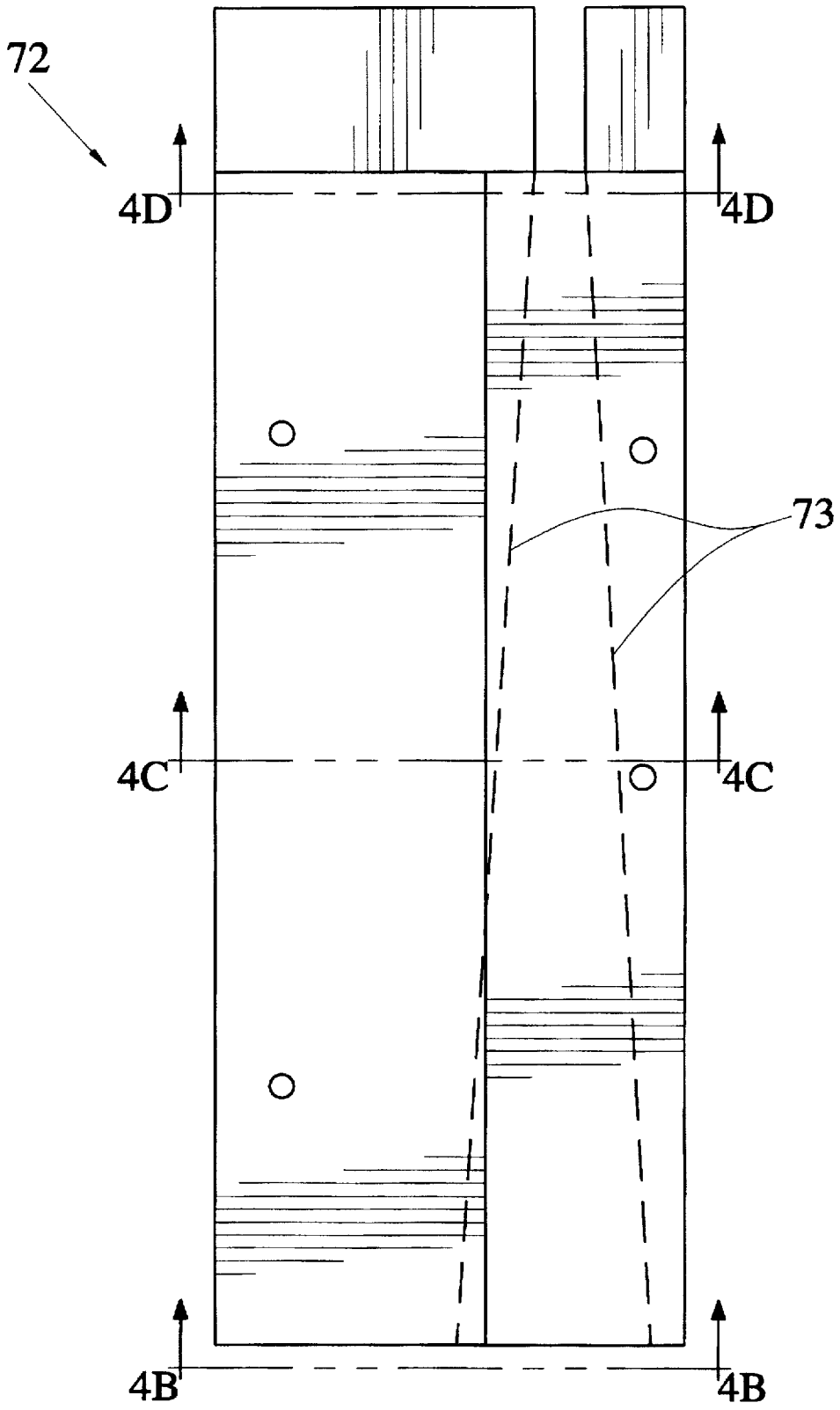
FIG. 4A is a top view of the seam folder.
Figure 4B:
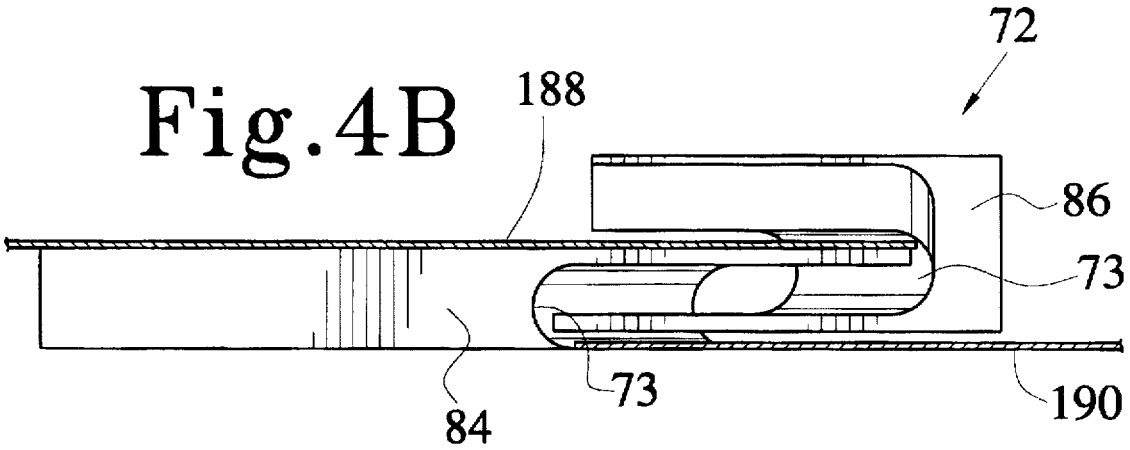
FIG. 4B is an end view of the first end of the seam folder.
Figure 4C:
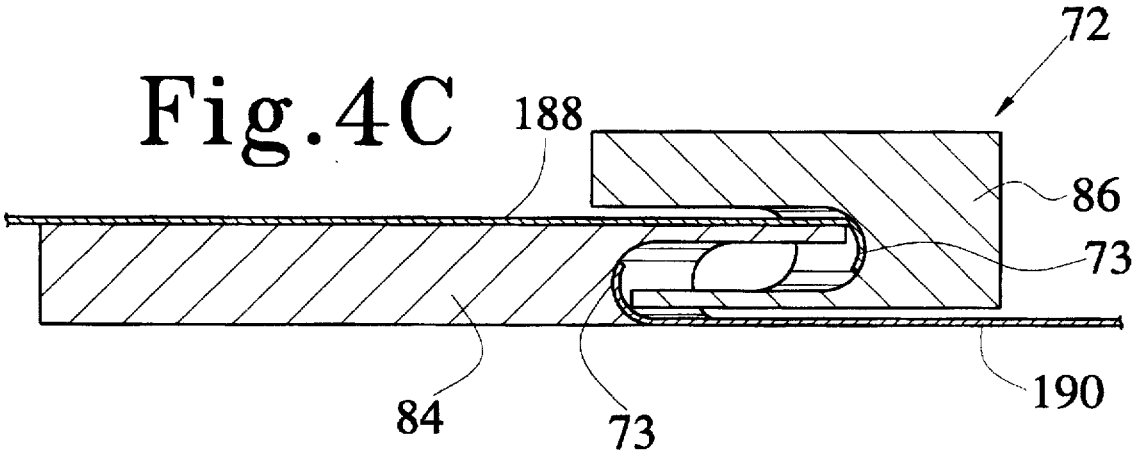
FIG. 4C is a cross sectional view of the seam folder taken along 4C—4C of FIG. 4A.
Figure 4D:
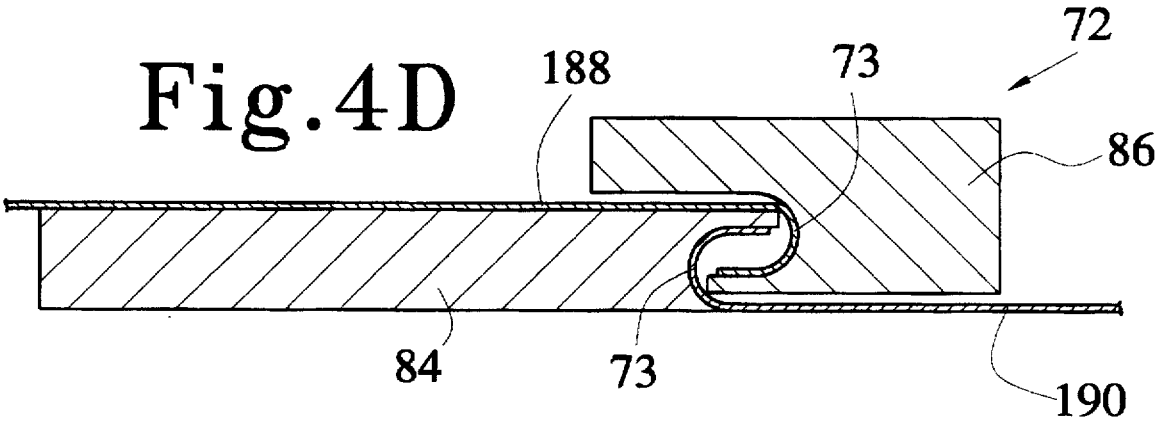
FIG. 4D is cross sectional view of the seam folder taken along 4D—4D of FIG. 4A.

FIG. 4B illustrates the first end of the seam folder 72. FIG. 4C is a cross sectional view of the seam folder 72 taken along line 4C—4C of FIG. 4A and FIG. 4D is a cross sectional view of the seam folder 72 taken along line 4D—4D of FIG. 4A. FIGS. 4B–4D illustrate the progression of the panel 188 and the riser 190 fed into the seam folder 72 to create an interlocking seam. As shown in FIG. 4B, the panel 188 and the riser 190 enter the seam folder 72 in a flat manner. As they progress through the seam folder 72, they are forced up the curved walls 73 of the seam folder 72, as shown in FIG. 4C. The panel 188 and the riser 190 leave the seam folder 72 in an interlocked manner, as shown in FIG. 4D. It will be noted that FIG. 4A shows two sectional lines indicating the narrowing of the distance between the opposing curved walls 73 from the first end to the second end of the seam folder 72.

Figure 5:
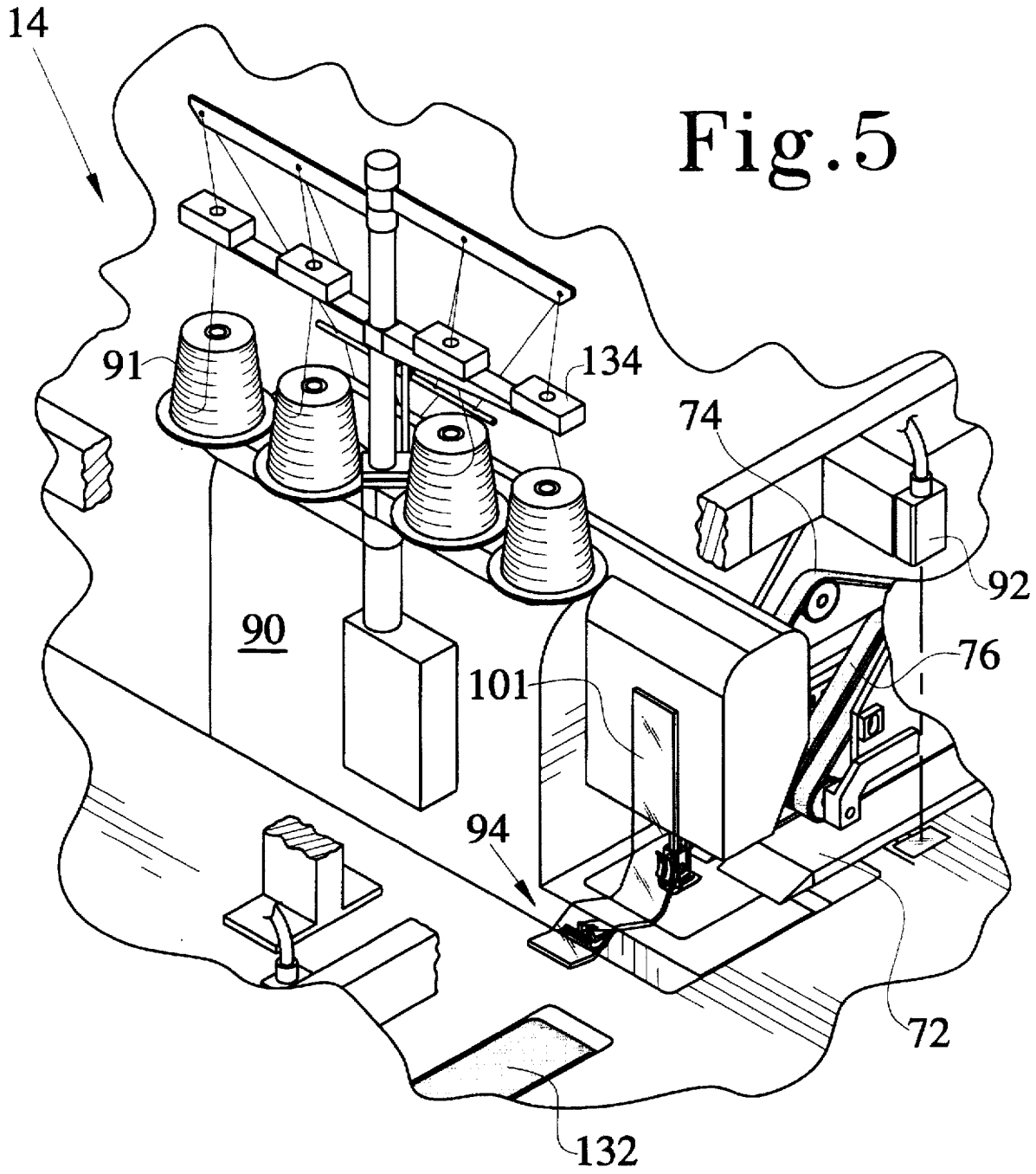
FIG. 5 is a perspective view of the sewing unit.

FIG. 5 illustrates a view of the sewing unit 14 which includes a sewing machine 90 mounted to the support table 20, a waste thread collector 94 for cutting and collecting waste thread and a sewing sensor 92 for controlling the operation of the sewing machine 90 and the waste thread collector 94. The sewing machine is conventional and its arm projects over the path of the seam exiting from the seam folding unit 16. The waste thread collector 94 is positioned a selected distance from the sewing machine 90. In the preferred embodiment, the sewing unit 14 includes at least one wheel 116 positioned proximate the sewing machine 90 for moving the sewn article away from the sewing machine 90. In the preferred embodiment, the sewing machine 90 is an industrial sewing machine and preferably, 5642 PFAFF. In the preferred embodiment, a thread break sensor 134 is mounted above each thread cone 91 of the sewing machine 90 and is configured to sense a break in the thread. Preferably, the sewing sensor 92 is a reflective light sensor.

A sectional view of the waste thread collector 94 is shown in FIG. 6C and is generally comprised of a cutter 96, and a suction assembly 95. The suction assembly 95 includes a guide 97, a suction tube 98, a suction device 100, a delivery tube 99 and a collection bin 102. The guide 97, shown in FIG. 6A, and the cutter 96 are positioned slightly above the support table 20, as shown in FIG. 6C. An end view of the waste thread collector is shown in FIG. 6B. As shown in FIG. 6C, the guide 97 is situated at the first end 104 of the suction tube 98 and the suction tube 98 extends downward from the support table 20. The second end 106 of the suction tube 98 and the first end 105 of the delivery tube 99 is in communication with the suction device 100. The suction device 100 is configured to create a vacuum effect in the suction tube 98 and a forceful blowing effect in the delivery tube 99 such that a cut piece of thread is sucked into and through the suction tube 98 and delivered via the delivery tube 99 to the collection bin 102 which is situated at the second end 107 of the delivery tube 99.

In the preferred embodiment, the suction device 100 includes a valve tee 114 wherein one leg of the tee 114 defines an wide opening 108 which narrows to a smaller opening 110, as shown in FIG. 6C. When air is injected forcefully though the wide opening 108 to the narrow opening 110, a vacuum effect is created in the suction tube 98 and a forceful blowing effect is created in the delivery tube 99, this effect is known as the venturi effect. The suction device 100 is activated via a solenoid (not shown) during the sew cycle.

In the preferred embodiment, the sewing unit also includes a material guide 101, shown most clearly in FIG. 6C, under which the sewn article and trailing piece of thread are guided. The material guide 101 forces the thread downward onto the cutter 96.

In the preferred embodiment, the automated sewing system 10 includes a stacker unit 18 for stacking the sewn articles. It will be noted that stacking of the sewn articles can be done manually but for a fully automated system, a stacker unit 18 is needed. The stacker unit 18, shown in FIGS. 1 and 2, is specifically designed for separately stacking the right and left rear legs once produced. In the preferred embodiment, the stacker unit 18 includes two legs 117. Each leg 117 includes a pneumatic cylinder 118, each defining a first end 120 and a second end 122. The stacker unit 18 is supported by a tacker support structure 124 which is supported by the upper support structure 32, as shown in FIGS. 1 and 2. A clamping device 126 is slidably mounted to each pneumatic cylinder 118. Further, the stacker unit 18 includes a left stacker sensor 128 and a right stacker sensor 129 each positioned before the left and right legs of the stacker unit 18, respectively.

In the preferred embodiment, the support table 20 defines first and second transporting belts 130, 132, as shown most clearly in FIG. 2. The first transporting belt 130 extends from the seam folding unit 16 to the second end 186 of the support table 20. The second transporting belt 132 extends from just beyond the sewing machine 90 to the second end 186 of the support table 20. These conveying belts 130, 132 assist in the movement of the panel and the subsequent sewn pant leg down the support table 20.

Further, in the preferred embodiment, a wheel 136 is mounted to the bottom of each of the legs 138 of the support table 20 such that the system 10 is mobile, as shown in FIG. 1. Moreover, the length of each of the legs 138 of the support table 20 is adjustable such that the height of the table 20 is adjustable.

Figure 10:
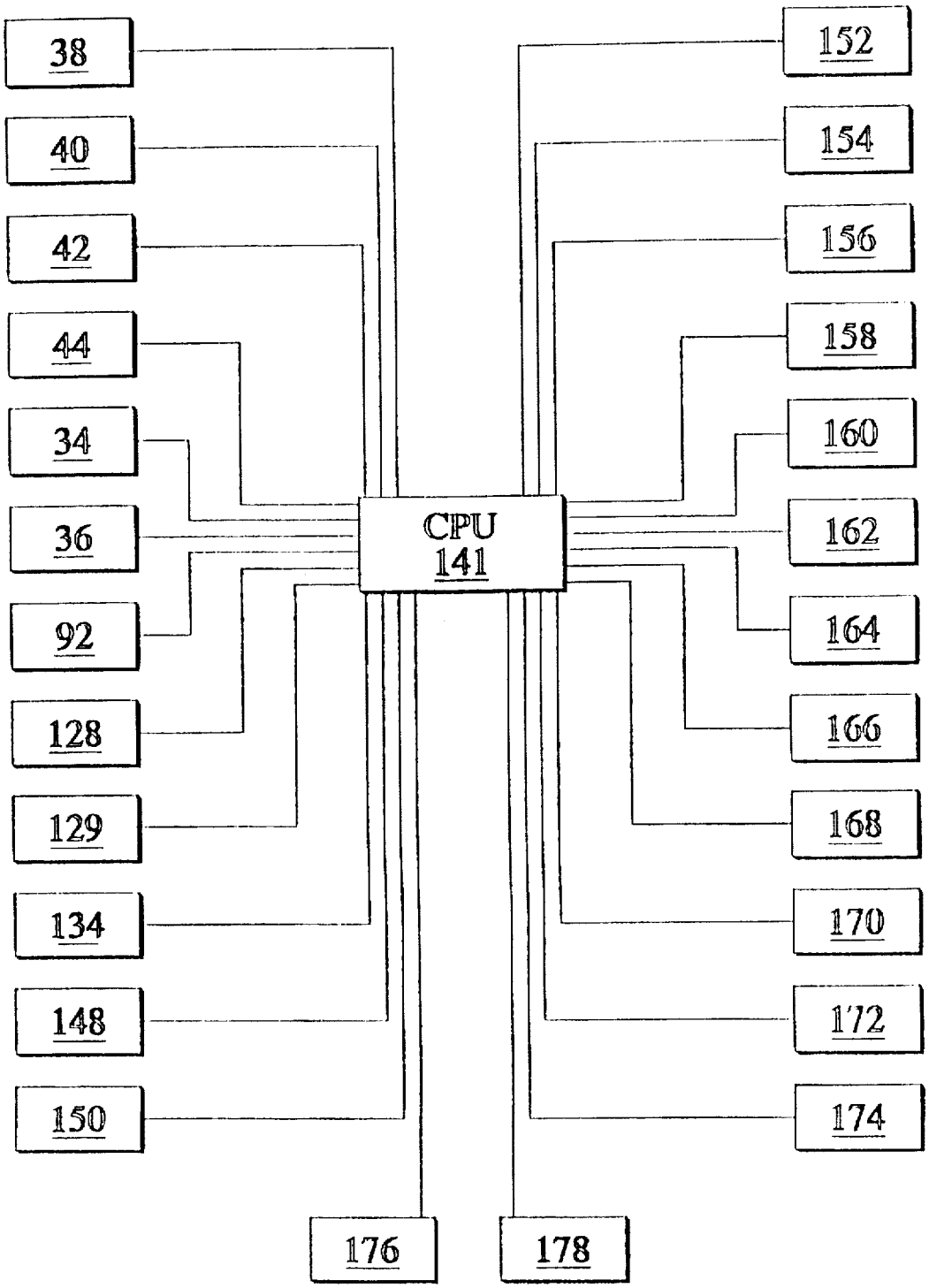
FIG. 10 is a block diagram of the control system.

As stated above, the automated sewing system 10 shown in the Figures is configured and designed specifically for sewing a riser to a panel to produce the rear right and left pant legs of a pair of denim jeans. The system 10 is controlled via a control system 140, a block diagram of which is shown in FIG. 10. Specifically, the control system 140 monitors and controls the operation of the loading unit 12, the seam folding unit 16, the sewing unit 14 and the stacker unit 18. The control system 140 includes all the sensors and a central processing unit (CPU) 141 to which all the sensors deliver signals. The signals are processed by the CPU 141 to monitor and operate system 10. Further, the control system includes a main control panel 142, secured to the side of the support table 20, a first control panel 144, situated proximate the loading unit 12, and a second control panel 146, secured below the support table 20 proximate the loading unit 12 (not shown), as shown in FIG. 1. The control panels 142, 144, 146 provide control switches and indicating lights for controlling and monitoring the system 10.

In the preferred embodiment, the control system 140 is set up such that the automated sewing system 10 produces right and left pant legs in an alternating manner. The control system 140 includes a means for overriding and resetting the initial set up. The first control panel 144, shown in FIG. 7, includes an alignment edge selector 148, for selecting whether the leading edge or the trailing edge of the riser and panel is sensed, and an alignment edge lock 150 for locking the system 10 such that only left rear pant legs or right rear pant legs are made. Further, the first control panel 144 includes a stacker selector 152 for selecting the right or left leg 117 of the stacker unit 18 and a stacker lock 154 for locking the stacker unit 18 such that the sewn articles are stacked by one leg 117 of the stacker unit 18. Further, the first control panel 144 includes riser and panel loading sensor indicating lights 156 connected to each loading sensor 34, 36 and a thread break sensor indicating light 158 connected to the thread break sensor 134. Further, the first control panel 144 includes an emergency stop switch 160 and a reset switch 162. Moreover, the first control panel 144 includes machine height controls 164 for raising and lowering the height of the support table 20. In the preferred embodiment, the first control panel 144 also includes leading and trailing edge panel position controls 166 for controlling a time delay.

The general operation of the system 10 is depicted in the flow chart of FIG. 8 and is conducted as follows. The power to system 10 is turned on. In the preferred embodiment, the power on/off switch 168 is located at the main control panel 142. The control system 140 is configured such that the initial alignment mode at system power up is for leading edge detection. In the preferred embodiment, the seat seam side of the panels and risers is sensed, therefore the leading edge of right risers and right panels is sensed and the trailing edge of left risers and left panels is sensed. Consequently, a right riser and a right panel are loaded in the loading unit 12 after initial power up. It will be noted that the risers are always fed in the right side of the loading unit 12 and panels are always fed in the left side of the loading unit 12.

Figure 7:
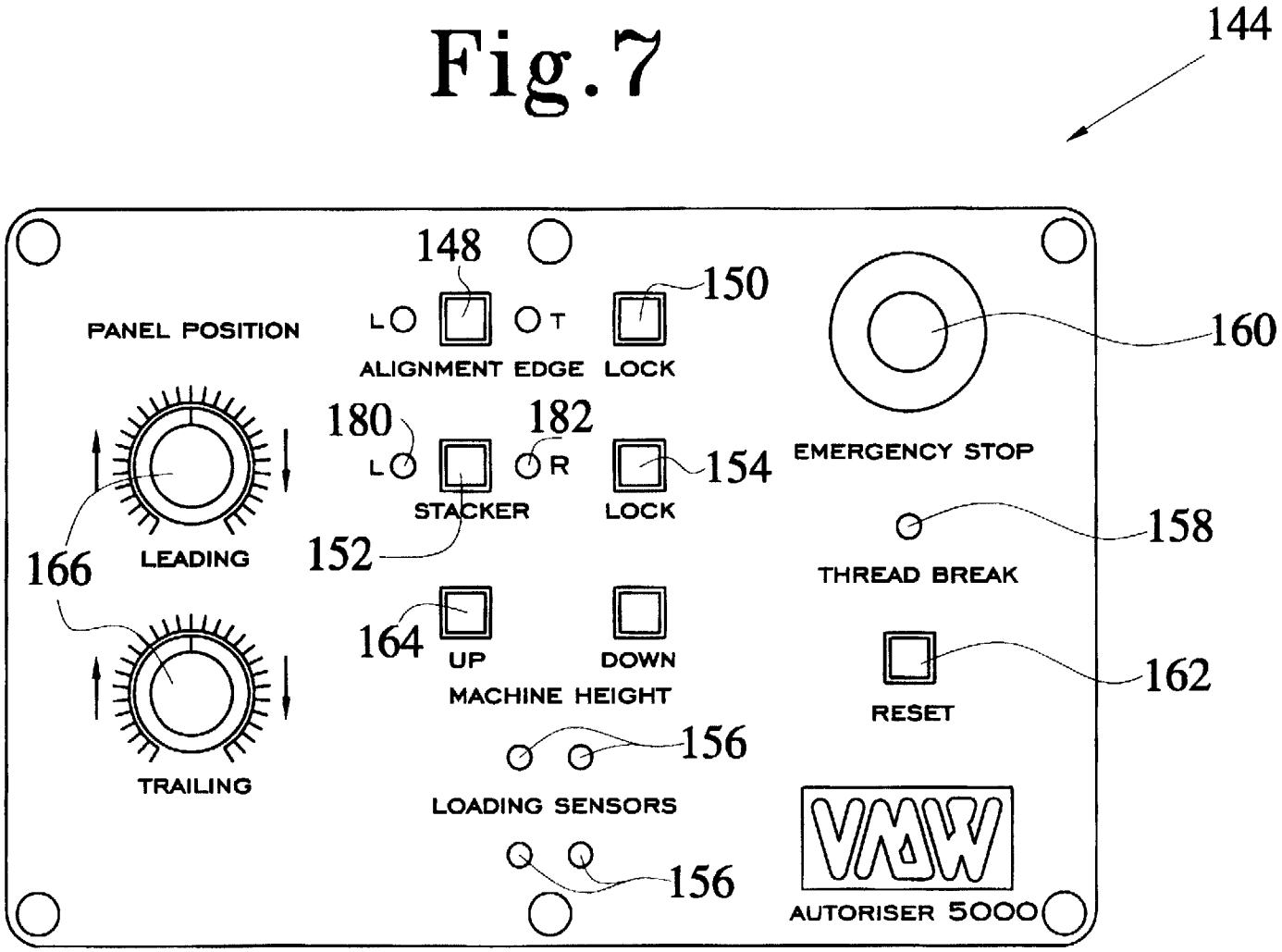
FIG. 7 is the first control panel.
Figure 8A:
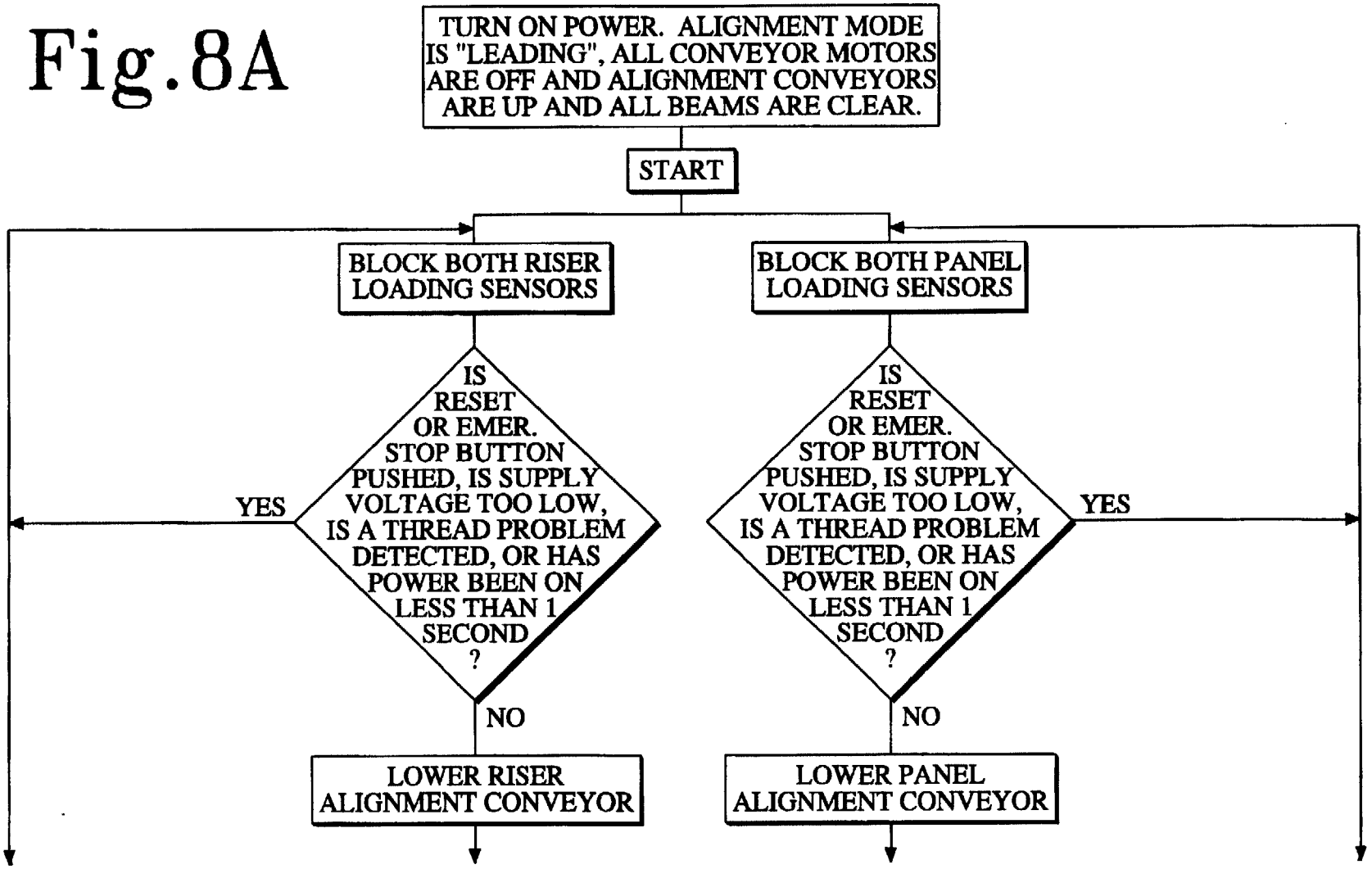
Figure 8B:
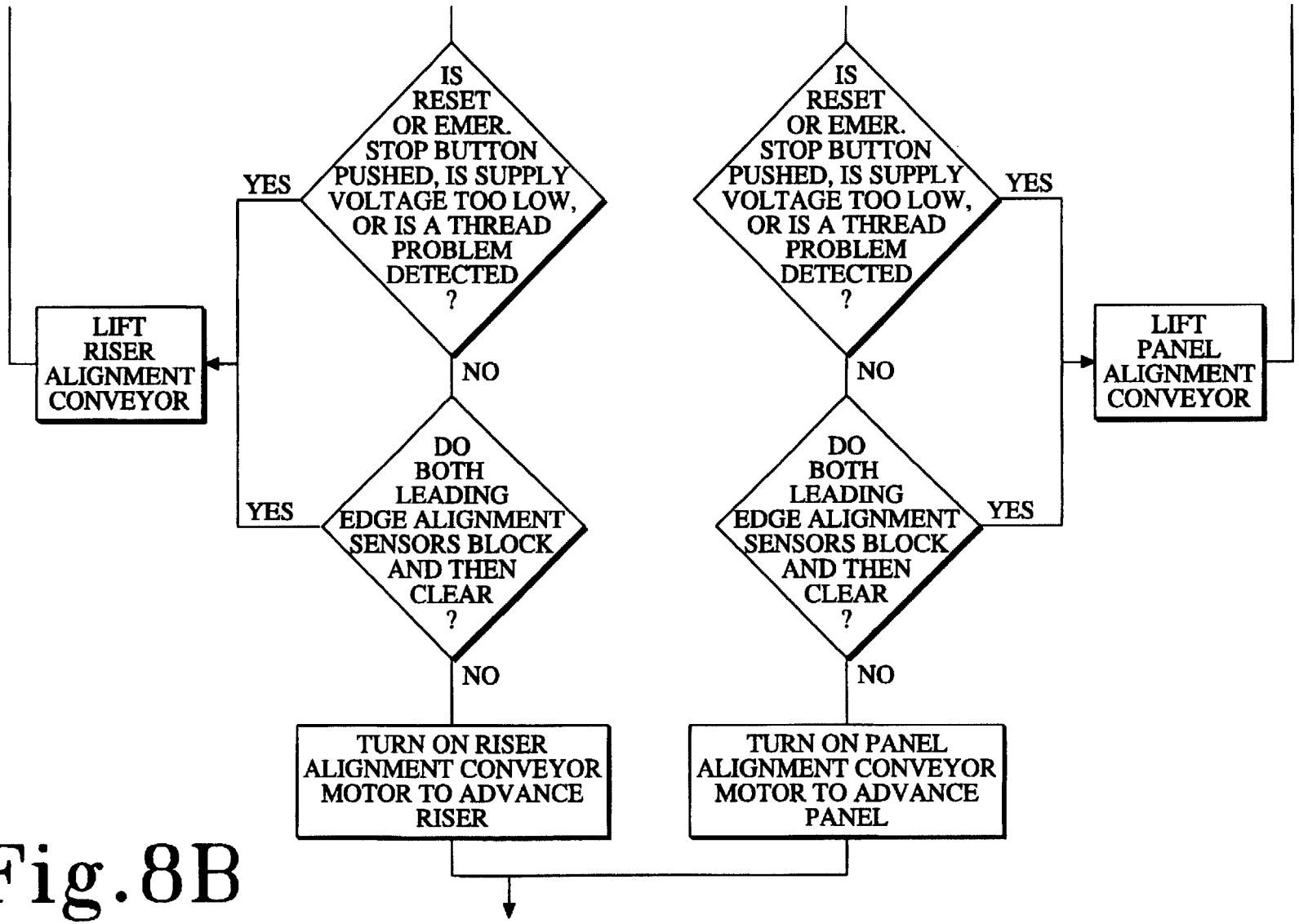
Figure 8C:
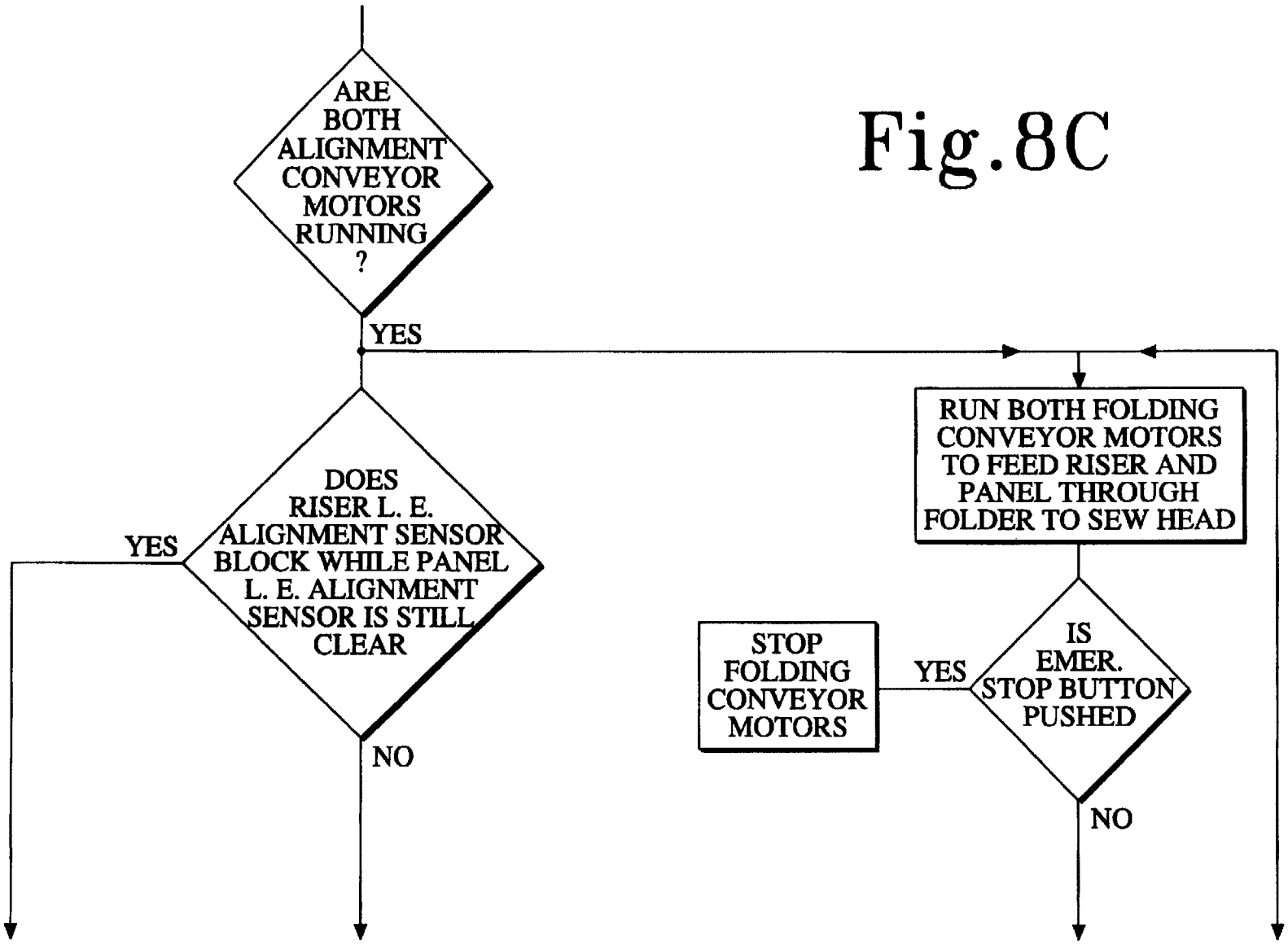
Figure 8D:
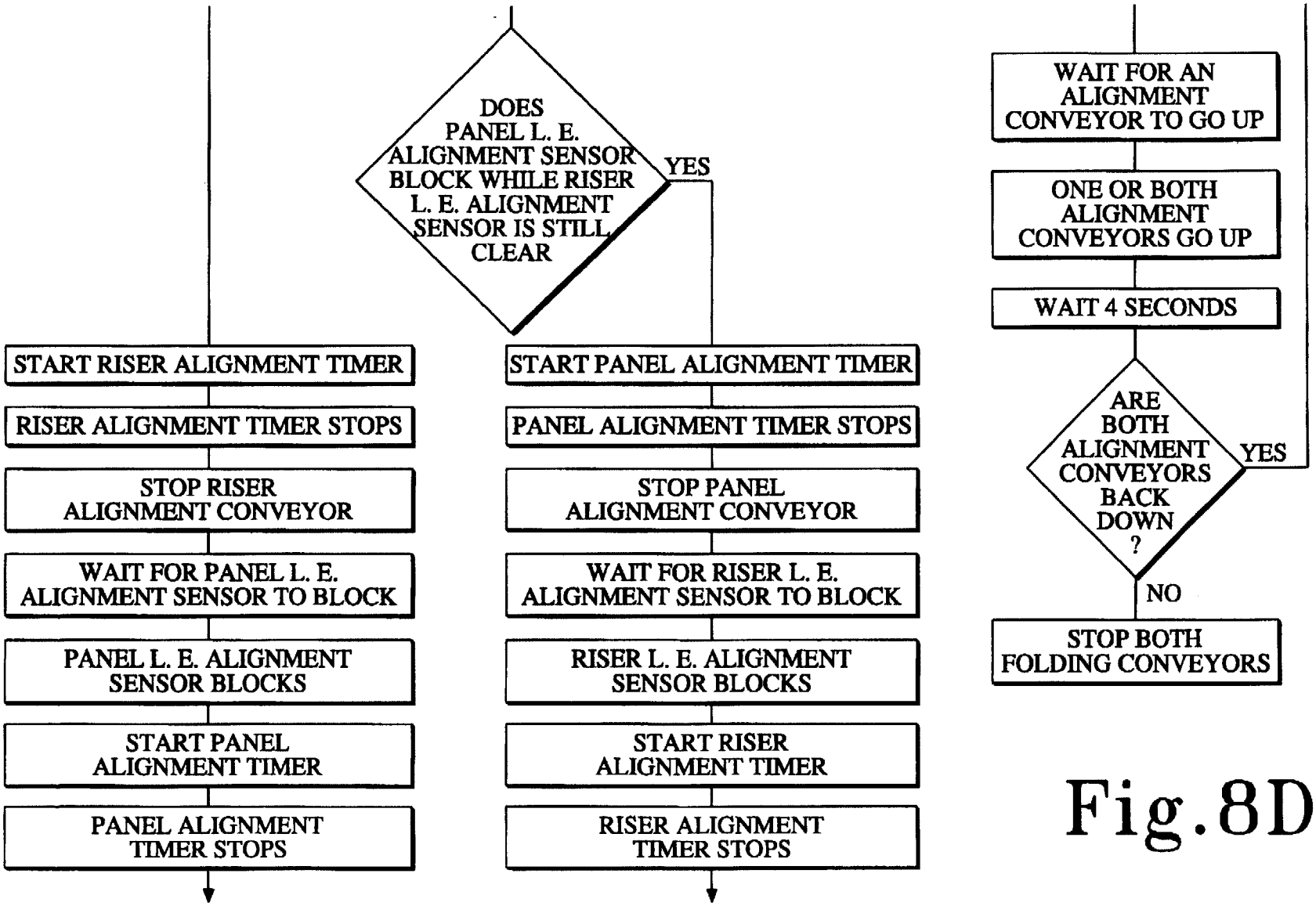
Figure 8F:
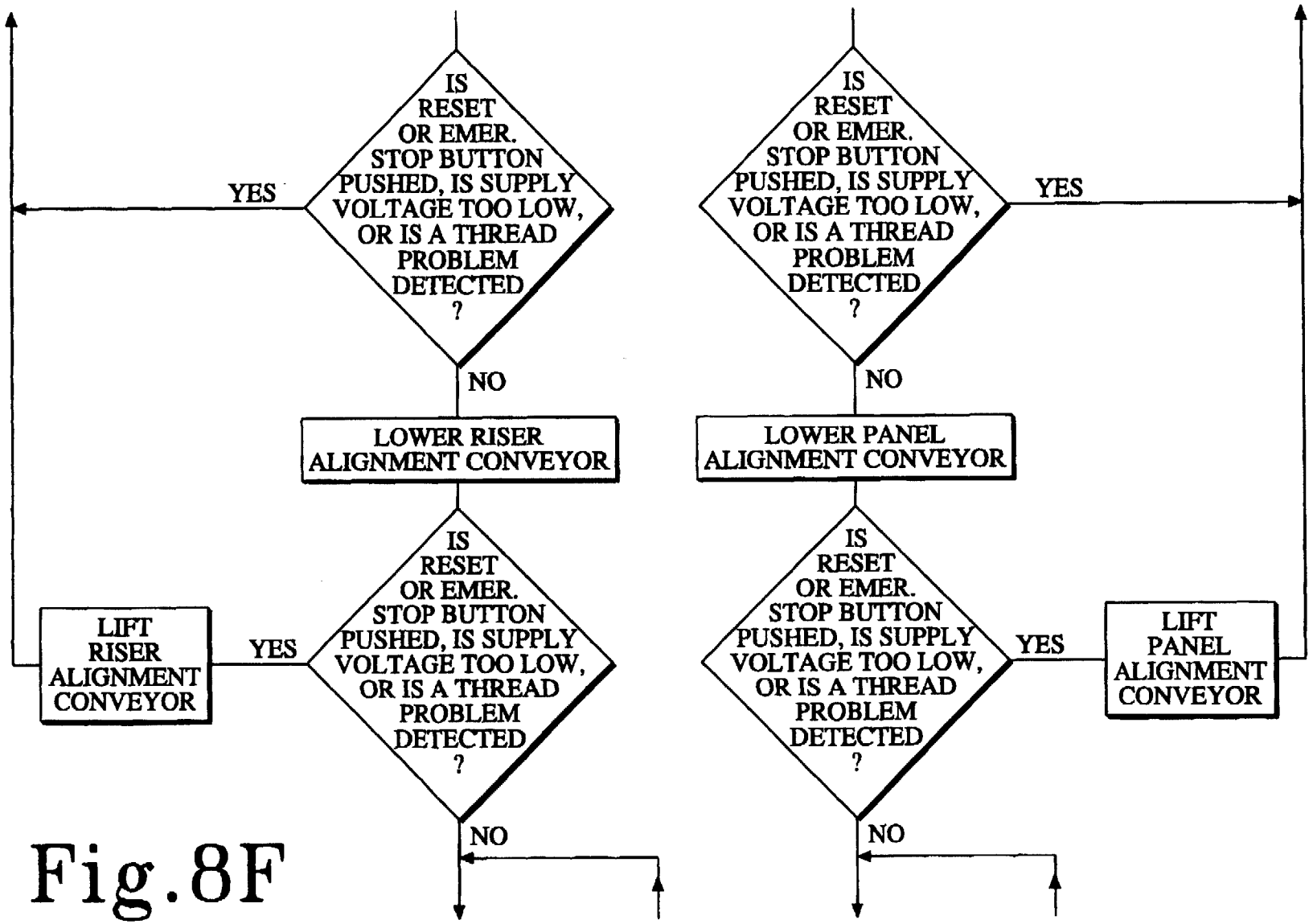
Figure 8F:
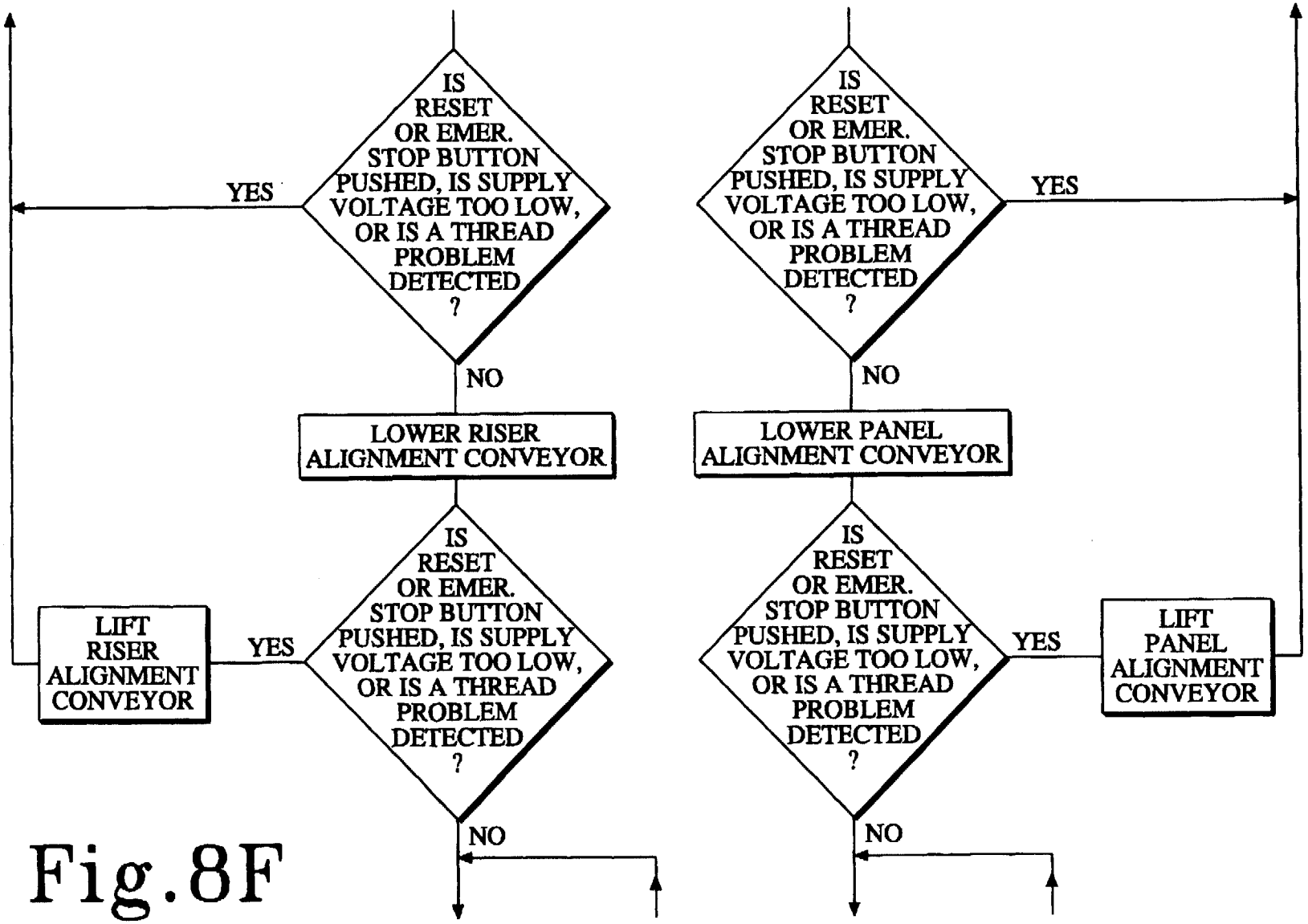
Figure 8G:
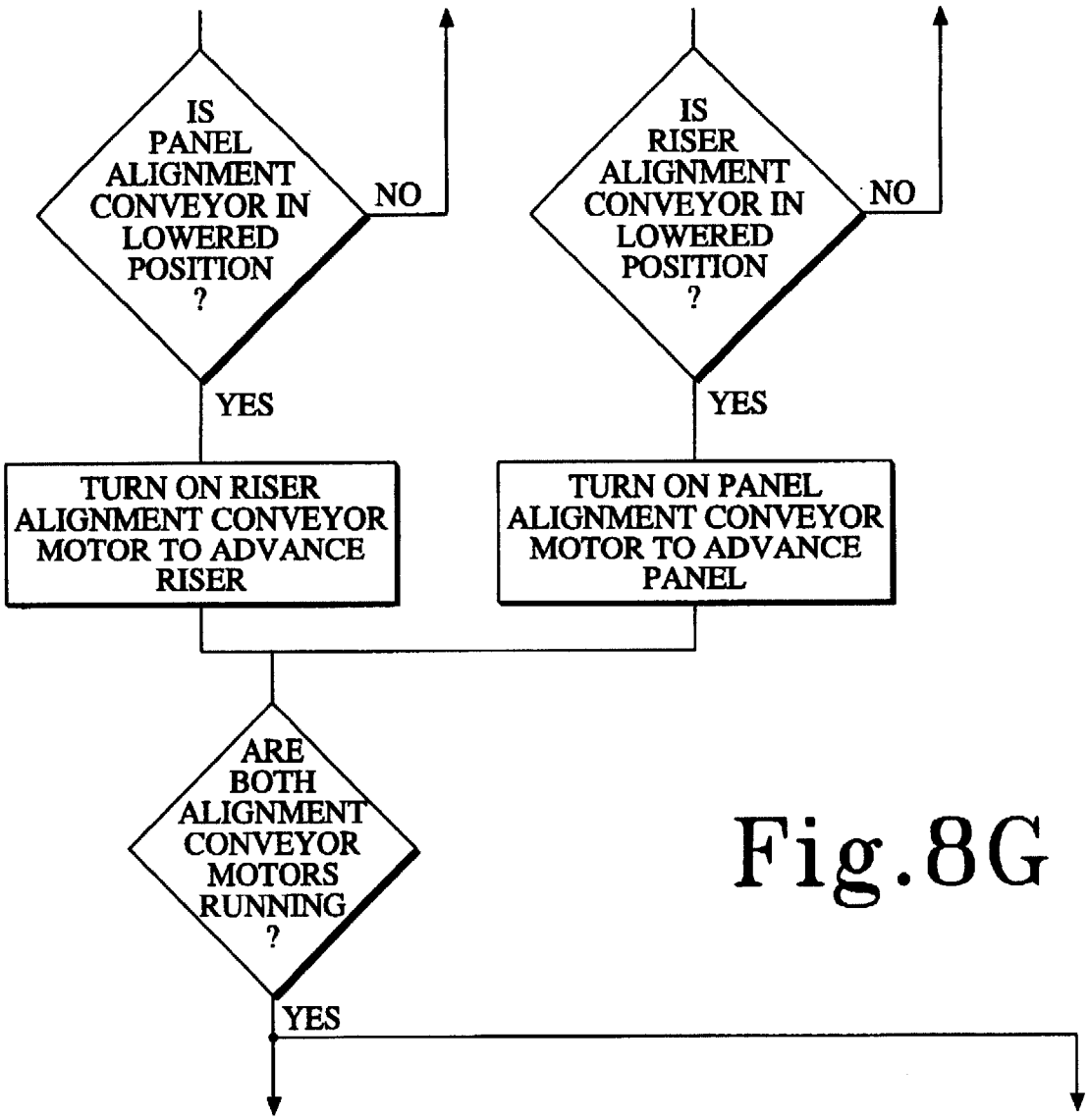
Figure 8H:
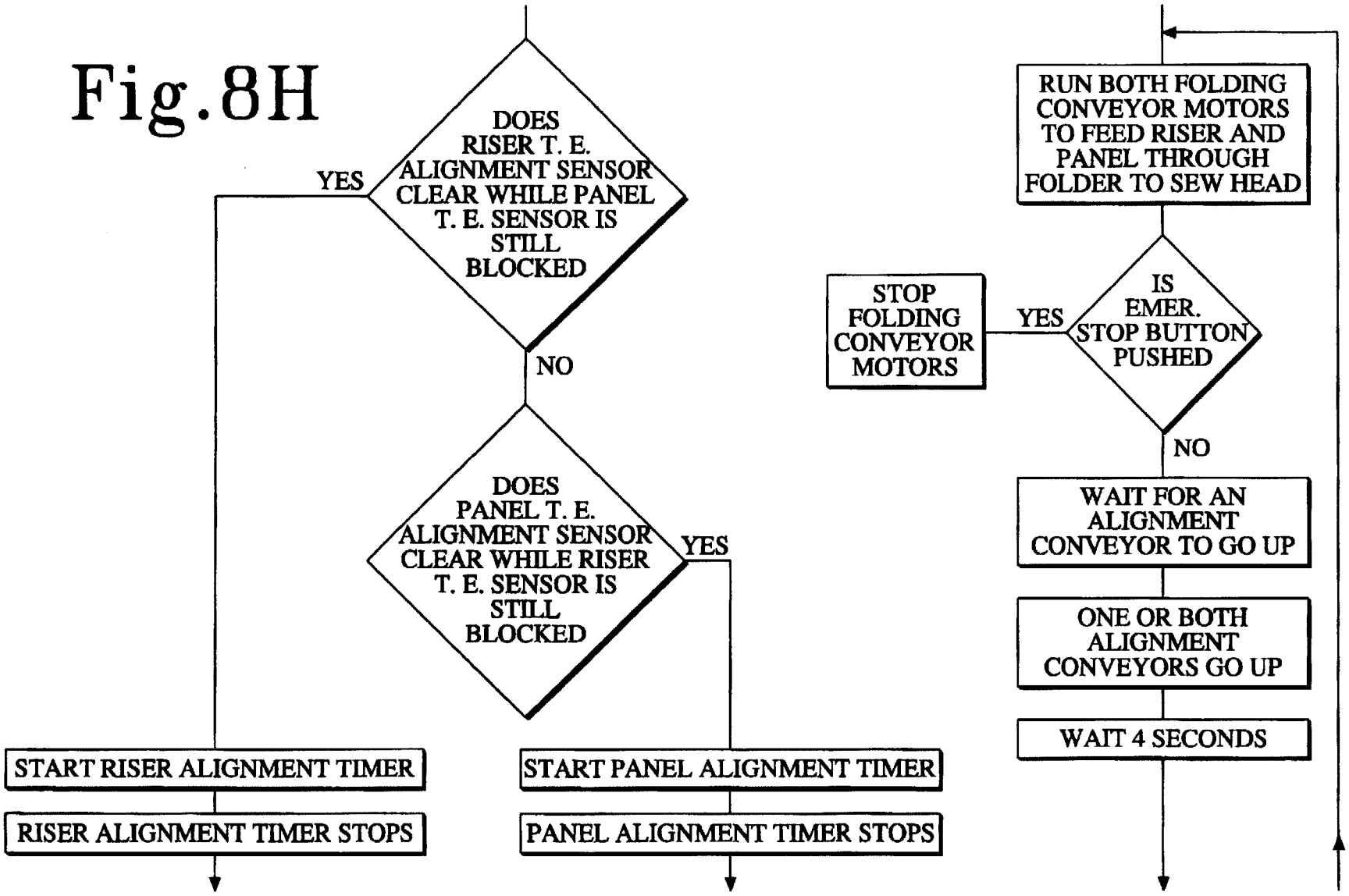
Figure 8I:
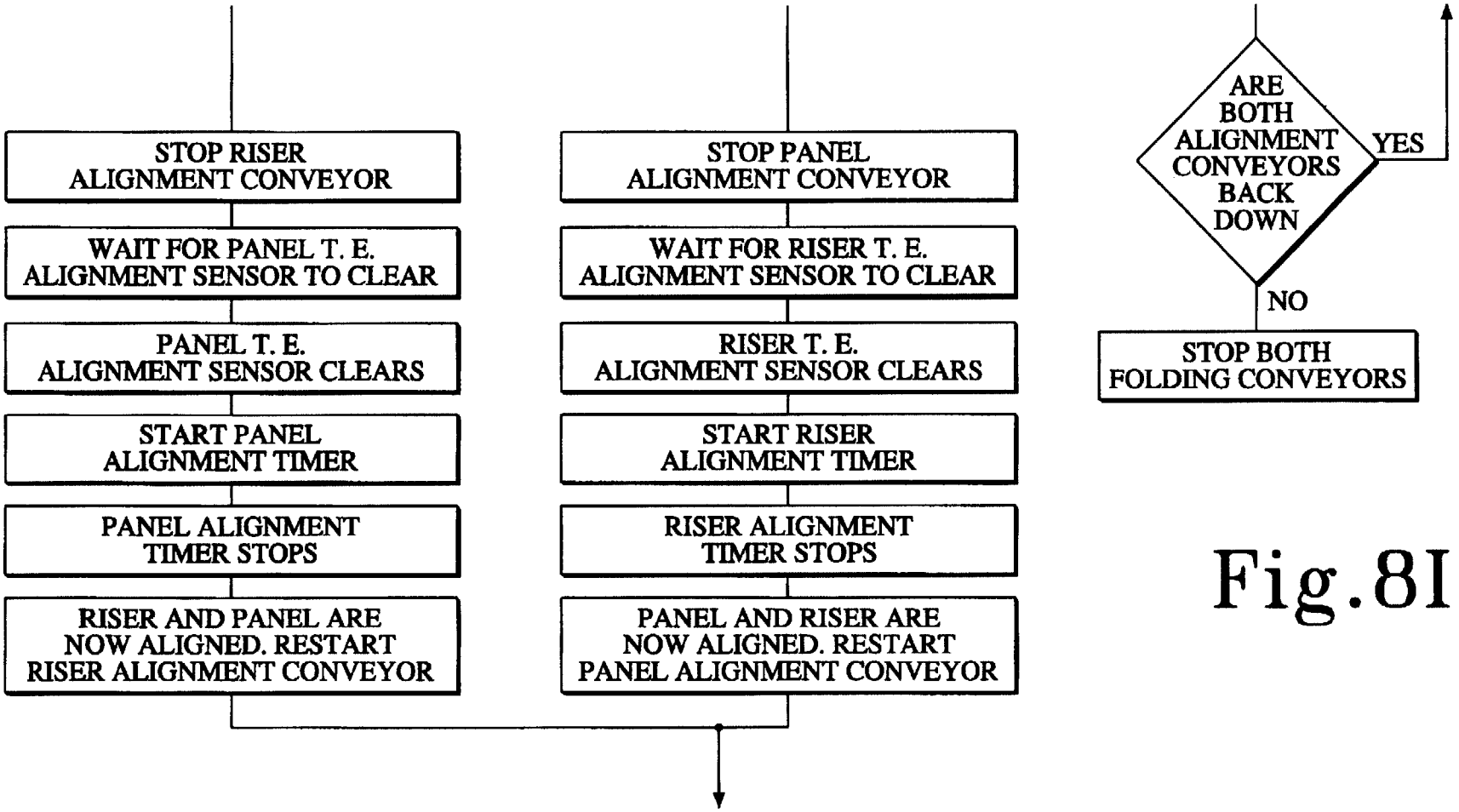
Figure 8J:
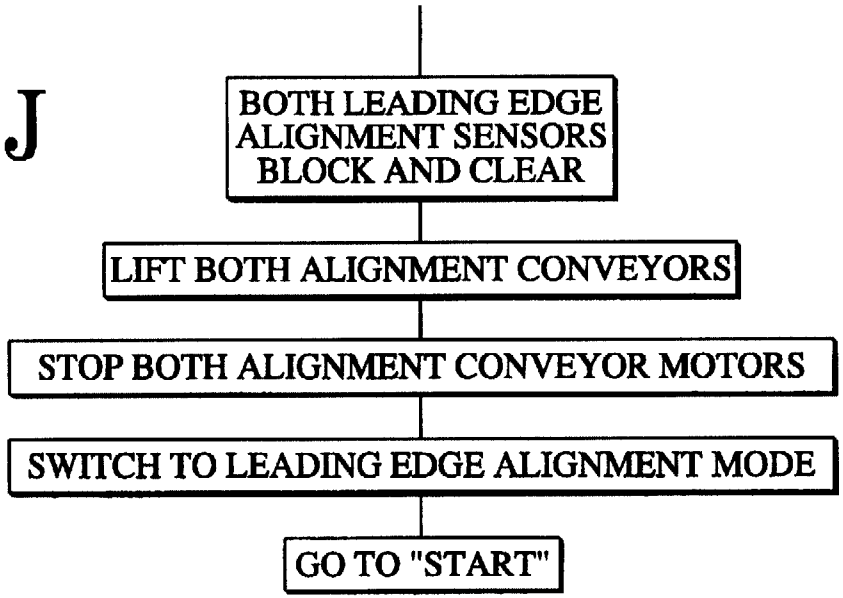

To properly load a riser and a respective panel, the riser is inserted into the right side of the loading assembly 46 such that it abuts squarely against the riser edge notch 58. The panel is inserted into the left side of the loading assembly 46 such that it abuts squarely against the panel edge notch 60. The riser and panel loading sensors 34, 36 indicate whether each is properly positioned. When all of the indicating lights 156 corresponding to each of the riser and panel loading sensors 34, 36 mounted to the first control panel 144, as shown in FIG. 7, are lit (indicating that all loading sensor beams have been broken), the riser and panel are properly positioned.

Once the riser is properly positioned, the riser loading sensors 34 trigger the pneumatic cylinder 30 controlling the raising and lowering of the loading unit riser conveying belt assembly 22 to lower. With the belt assembly 22 lowered, the riser is secured in position. Likewise, once the panel is properly positioned, the panel loading sensors 36 trigger the pneumatic cylinder 30 controlling the raising and lowering the loading unit panel conveying belt assembly 24 to lower. With the belt assembly 24 lowered, the panel is secured in position.

As the riser and panel become secured in position by the lowering of their respective conveying belt assemblies, their respective loading unit riser motor 26 or panel motor 28 are started to advance the riser and panel toward the leading edge alignment sensors 38, 42 or the trailing edge alignment sensors, 40, 44. The leading edge alignment sensors 38, 42 are used to align the leading edges of right leg risers and panels, and the trailing edge alignment sensors 40, 44 are used to align the trailing edges of left leg risers and panels.

When right leg risers and panels are being aligned and the riser is loaded before the panel, the loading unit riser conveying belt assembly 22 advances the riser until the riser leading edge sensor's beam is broken. The riser alignment timer is started and runs for a selected amount of time and subsequently stops. The riser conveying belt assembly 22 then stops advancing the riser. The control system 140 is programmed to hold the riser in this position to await the alignment of the panel with the riser.

When the right leg panels are loaded before the riser, they are aligned in the same manner as when right leg risers are loaded before the panel. Specifically, the panels are advanced by the panel conveying assembly 24 until the beam of the leading edge sensor 42 is broken. The panel alignment timer starts and stops, and then the panel is held in that position by the control system 140 to await the alignment of the riser with the panel.

Alignment occurs when the beams of both of the leading edge sensors 38, 42 are blocked, and both alignment timers have started and stopped. At this point, both conveying belt assemblies 22, 24 resume advancing their respective riser and panel pieces.

When left leg risers and panels are aligned, they are simultaneously advanced until the beams of their respective trailing edge sensors 40, 44, are cleared by the trailing edges of the riser and panel. The first piece to clear its trailing edge sensor is held in place by its conveying assembly 22, 24 until the second piece clears its trailing edge sensor, 40, 42. At this point, both pieces are aligned and both conveying assemblies 22, 24 resume advancing their respective riser and panel pieces.

In the preferred embodiment, the control system 140 includes the leading and trailing edge panel position controls 166 which are utilized to change the panel alignment timer if it is running too fast or too slow with respect to the riser alignment timer.

During the operation of the system 10, the folding unit riser and panel conveying belt assemblies 74, 76 are always in a lowered position. The folding unit conveying belt assemblies 74, 76 can be raised and lowered via the respective pneumatic cylinders 30 if a problem occurs in the folding unit.

Once the riser and panel are aligned, the loading unit riser and panel conveying belt assemblies 22, 24 begin rotating via their respective motors 26, 28 to advance the riser and the panel and the edges the riser and the panel are fed into the seam folder 72. The seam folder 72 is configured such that the edges of the riser and panel fold over each other and interlock to form a seam typical of the seams in denim jeans. The riser and panel folding unit conveying belt assemblies 74, 76, powered by the folding unit riser motor 78 and the folding unit panel motor 80, respectively, advance the riser and panel through the seam folder 72 and to the sewing unit 14.

In the preferred embodiment, the seam folding unit 16 provides a differential feed such that the riser can be fed to the sewing machine at a slower or faster rate than the panel to effectively stretch or compress the riser with respect to the panel. The differential feed permits the use of risers or panels which are incorrectly cut such that the leading and trailing ends of the riser and panel are more closely aligned in the sewn product. It will be noted that the maximum compression or stretch imparted to the riser with respect to the panel is approximately ⅛ of an inch due to the constraints of the denim fabric and the appearance of the sewn product.

Figure 9:
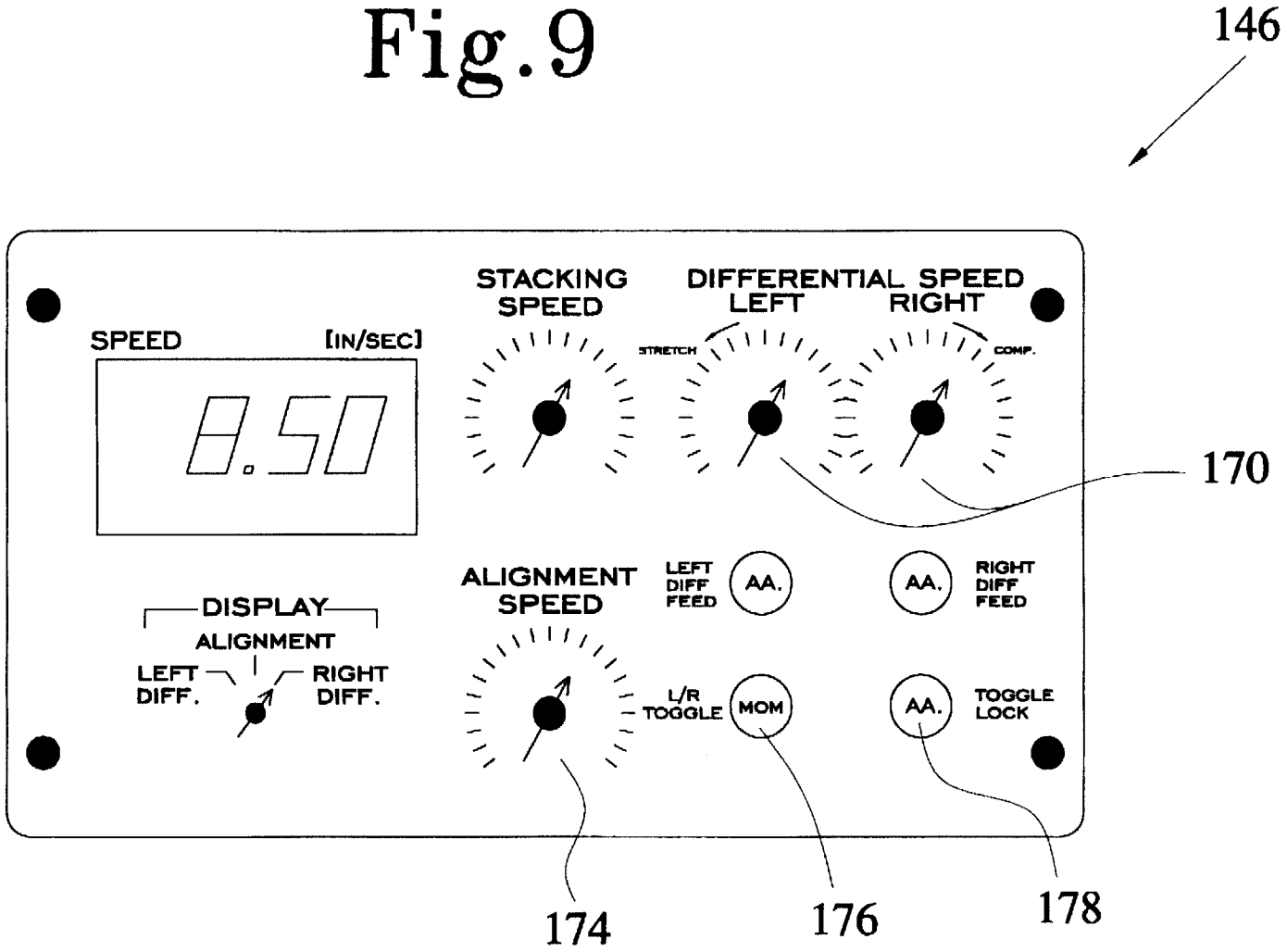
FIG. 9 is the second control panel.

The differential feed is accomplished by altering the speed at which the folding unit riser conveying belt assembly 74 feeds the riser into the sewing machine 90 with respect to speed at which the panel is fed into the sewing machine 90. Specifically, the speed at which the folding unit riser motor 78 runs is altered with respect to the speed at which the folding unit panel motor 80 runs. The second control panel 146, shown in FIG. 9, includes a riser fine control 170 for controlling the differential speed of the folding unit riser motor 78. The second control panel 146 also includes a fine control 174 for the establishing the base speed of the loading unit motors 26, 28 and the folding unit motors 78, 80. In the embodiment depicted, the coarse control for establishing the base speed of the loading and folding unit motors is located on the circuit board (not shown). In the preferred embodiment, the coarse control 172 ranges from 0–20 inches/second and the fine control 174 includes a range of ±1 inch/second. Further, in the preferred embodiment, the riser fine control 170 includes a range of approximately ±½ inches per second. It will be noted that the loading unit motors 26, 28 and the folding unit panel motor 80 always run at the same speed, only the speed of folding unit riser motor 78 can vary with respect to the remaining motors.

In the preferred embodiment, the second control panel 146 includes a right leg/left leg switch 176 which toggles between a differential speed selected for producing right pant legs and a differential speed selected for producing left pant legs during the normal alternating operation of the system 10. Further, the second control panel 146 includes a locking switch 178 for locking the right leg/left leg switch 176. It will be noted that the riser fine control can be set at 0 inches/second such that there is no differential speed between the folding unit riser motor 78 and the remaining motors.

During advancement through the seam folder 72, the folding unit riser and panel motors 78, 80 run at the same speed as the loading unit riser and panel motors 26, 28. Once the right leg panel is detected by the sewing sensor 92 and the control system 140 checks that the right leg/left leg switch 176 is toggled to the right leg and after a time delay of preferably one quarter of a second, the folding unit riser motor 78 is run at the differential speed selected for the right leg and the sewing machine begins sewing the riser and panel together. Once the trailing edge of the right leg panel is detected, a time period of preferably one quarter of a second passes and the sewing machine 90 discontinues sewing. The right leg/left leg switch 176 toggles to the left leg (unless locked in position) and the folding unit riser motor 78 returns to the base speed of the remaining motors.

During the operation of the sewing machine, the thread break sensors 134 monitor the flow of the thread from each of the thread cones 91. If a thread break sensor 134 senses a break in the thread, it activates the thread break sensor indicating light 158 at the first control panel 144 alerting the operator of the system 10 such that he can rethread the sewing machine 90 and reset the sensor. Further, when a thread break sensor is activated, the conveyors will not lower to start the next part of the process.

When the panel breaks the beam of the sewing sensor 92, the waste thread collector 94 is activated. The suction device 100 is activated pulling the thread 93 downward such that the thread comes in contact with the cutter to cut the thread. The waste thread is pulled down the suction tube 98 and the thread fragment travels through the suction tube 98 and the delivery tube to the collection bin 102. The waste thread collector 94 is deactivated after a time delay, once the trailing edge of the panel is sensed by the sewing sensor 92.

The sewn right leg moves under the wheel 116 and moves toward the stacker unit 18 via the first and second transporting belts 130, 132. The clamping device 126 which pulls the sewn article along its respective pneumatic cylinder 118 to deposit in a pile is determined by the stacker selector 152 of the first control panel 144. When the left indicating light 180 of the of the stacker unit is lit on the first control panel 144, the left stacker sensor 128 is activated. After the sewn article breaks the beam of the activated sensor, the clamping device 126 clamps down on the sewn article and pulls it from the support table 20 and drops it in a pile. In the normal alternating operation of the system 10, the sewn right rear legs are stacked by one leg of the stacker unit 18 and the sewn left legs are stacked by the remaining leg of the stacker unit 18. In the preferred embodiment, the left and right stacker sensors 128, 129 are reflective sensors.

The operation of the system 10 can be a continuous one. Once the loading unit 12 is cleared from the loaded riser and panel, the loading unit 12 resets and another riser and panel can be loaded into the loading unit 12. The folding unit motors 78, 80 run continuously unless a riser and panel are not loaded within 4 seconds after the preceding riser and panel leave the folding unit 16.

Sewing a left riser and left panel together is similar to operation for sewing a right riser and a right panel together except in that the trailing edge of the left riser and left panel is sensed and utilized for alignment.

Further, the system 10 can be set for the production of one leg only by locking the alignment edge lock 150 on the first control panel 144 to the appropriate alignment edge. When using differential speed, the right leg/left leg switch 176 on the second control panel 146 is locked. Preferably, the stacker lock is also locked such that one leg of the stacker unit 18 stacks the product.

It will be noted that the operation of automated sewing system 10 can be halted at anytime by depressing the emergency stop switch 160.

From the foregoing description, it will be recognized by those skilled in the art that an automated sewing system offering advantages over the prior art has been provided. Specifically, the automated sewing system provides a loading unit which assures that the articles to be sewn are properly aligned. Further, the loading unit alternates between sensing the leading and trailing edges of the articles to be sewn and to align them accordingly. The automated sewing system also includes a seam folding unit for interlocking the edges of the article to form a seam. Moreover, the automated sewing system includes a means for differentially feeding one of the articles to accommodate for a difference in length relative to the remaining article. The automated sewing system also includes a sewing unit with a waste thread cutter and collector.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, We claim:

1. An automated sewing system for sewing two articles together, said automated sewing system comprising:

a support table;

a loading unit positioned proximate the first end of said support table, said loading unit including a loading assembly for receiving the two articles, said loading unit including a first conveying assembly for clamping down on the two articles to securely maintain a relative disposition of the two articles and advancing the two articles to a seam folding unit supported on said support table;

said seam folding unit for receiving the edges of the two articles to fold a seam, said seam folding unit including a seam folder and a second conveying assembly for conveying the two articles through said seam folder and advancing the two articles to a sewing unit supported on said support table;

said sewing unit for sewing the two articles at the seam to produce a sewn product; and, a control system for monitoring and controlling said loading unit, said seam folding unit and said sewing unit.

2. The automated sewing system of claim 1 further including a stacker unit for stacking the sewn product, said control system monitoring and controlling said stacker unit, said stacker unit including a first leg and a second leg for separately stacking the sewn product, said control system including and a first stacker sensor and a second stacker sensor positioned proximate said first leg and said second leg, respectively, said control system including a stacker selector for activating said first stacker sensor and second stacker sensor such that when said first stacker sensor is activated the sewn product is stacked via said first leg and when said second stacker sensor is activated the sewn product is stacked via said second leg.

3. The automated sewing system of claim 1 wherein said loading assembly defines a riser edge notch, a riser support surface, a panel edge notch and a panel support surface, said riser edge notch for receiving the edge of one of the articles such that the article abuts squarely against said riser edge notch as the article rests on said riser support surface, said panel edge notch for receiving the edge of the remaining article such that the remaining article abuts squarely against said panel edge notch as the remaining article rests of the panel support surface, said riser support surface and said panel support surface positioned one directly above the other such that the two articles are overlapping when exiting said loading unit.

4. The automated sewing system of claim 3 wherein said control system includes at least one riser loading sensor and at least one panel loading sensor, said at least one riser loading sensor for detecting that the article resting on said riser support surface abuts squarely against said riser edge notch, said at least one panel loading sensor for detecting that the article resting on said panel support surface abuts squarely against said panel edge notch.

5. The automated sewing system of claim 4 wherein the two articles are right and left risers to be sewn to right and left panels, respectively, to form the right and left rear portions of a pair of jeans, respectively, the risers being supportable on said riser support surface and abutting against said riser edge notch, the panels being supportable on said panel support surface and abutting against said panel edge notch, said control system including a riser leading edge sensor, a riser trailing edge sensor, a panel leading edge sensor and a panel trailing edge sensor, said riser leading edge sensor being positioned for sensing the leading edge of a right riser, said panel leading edge sensor for sensing the leading edge of a right panel, said riser trailing edge sensor for sensing the trailing edge of a left riser, said panel trailing edge sensor for sensing the trailing edge of a left panel, said control system utilizing said riser and panel leading edge sensors and said riser and panel trailing edge sensors to align a left riser with a left panel and a right riser with a right panel, respectively.

6. The automated sewing system of claim 5 wherein said loading unit operates in an alternating manner such that said leading edge sensors are activated and a right riser and a right panel are loaded in said loading unit for alignment, upon alignment and advancement to said seam folding unit said trailing edge sensors are activated and a left riser and left panel are loaded in said loading unit for alignment.

7. The automated sewing system of claim 1 wherein said seam folder is configured to receive the edges of the article therethrough, said seam folder being configured such that the edges of the two articles form an interlocking seam.

8. The automated sewing system of claim 1 wherein said sewing unit includes a sewing machine supported by said support table for sewing the two articles at the seam, said control system including a sewing sensor for controlling the operation of the sewing machine, said sewing sensor being positioned between said sewing machine and said seam folding unit, said sewing sensor sensing a leading edge of one of the articles as it exits the seam folding unit triggering the operation of said sewing machine, said sewing sensor sensing when the trailing edge of the article clears said sewing sensor thereby triggering the cease of operation of said sewing machine, said control system defining a time delay upon detection of the trailing edge of the article via said sewing sensor such that said sewing machine ceases operation after said time delay.

9. The automated sewing system of claim 8 wherein said sewing unit further includes a waste thread collector for cutting and collecting waste thread fragments, the operation of said waste thread collector being controlled by said sewing sensor, said waste thread collector including a cutter, a suction assembly and a material guide, said cutter being mounted to said support table proximate said sewing machine, said suction assembly being positioned between said cutter and said sewing machine such that a sewn article passes over said suction assembly and said cutter, said material guide being positioned above said cutter and said suction assembly such that the sewn article passes between said material guide and said cutter and said suction assembly, said material guide for forcing the sewn article and excess thread downward on said cutter, said suction device for pulling a cut piece of thread away from the sewn article.

10. The automated sewing system of claim 8 wherein said sewing unit further includes a thread break sensor mounted proximate a thread cone of said sewing machine, said thread break sensor for detecting a break in the thread.

11. An automated sewing system for sewing two articles together, said automated sewing system comprising:

a support table;

a loading unit positioned proximate the first end of said support table, said loading unit including a loading assembly which defines a riser edge notch, a riser support surface, a panel edge notch and a panel support surface, said riser edge notch for receiving the edge of one of the articles such that the article abuts squarely against said riser edge notch as the article rests on said riser support surface, said panel edge notch for receiving the edge of the remaining article such that the remaining article abuts squarely against said panel edge notch as the remaining article rests on the panel support surface, said riser support surface and said panel support surface positioned one directly above the other such that the two articles are overlapping when exiting said loading unit, said loading unit further including a first conveying assembly for clamping down on the two articles to securely maintain a relative disposition of the two articles and advancing the two articles to a seam folding unit supported on said support table;

said seam folding unit including a seam folder and a second conveying assembly, said seam folder configured to receive the edges of the article therethrough, said seam folder being configured such that the edges of the two articles form an interlocking seam, said second conveying assembly for conveying the two articles through said seam folder and advancing the two articles to a sewing unit supported on said support table;

said sewing unit for sewing the two articles at the seam to produce a sewn product; and, a control system for monitoring and controlling said loading unit, said seam folding unit and said sewing unit.

12. The automated sewing system of claim 11 further including a stacker unit for stacking the sewn product, said control system monitoring and controlling said stacker unit, said stacker unit including a first leg and a second leg for separately stacking the sewn product, said control system including and a first stacker sensor and a second stacker sensor positioned proximate said first lea and said second leg, respectively, said control system including a stacker selector for activating said first stacker sensor and second stacker sensor for stacking the sewn product below said first lea and said second leg, respectively.

13. The automated sewing system of claim 11 wherein said control system includes at least one riser loading sensor and at least one panel loading sensor, said at least one riser loading sensor for detecting that the article resting on said riser support surface abuts squarely against said riser edge notch, said at least one panel loading sensor for detecting that the article resting on said panel support surface abuts squarely against said panel edge notch.

14. The automated sewing system of claim 13 wherein the two articles are right and left risers to be sewn to right and left panels, respectively, to form the right and left rear portions of a pair of jeans, respectively, the risers being supportable on said riser support surface and abutting against said riser edge notch, the panels being supportable on said panel support surface and abutting against said panel edge notch, said control system including a riser leading edge sensor, a riser trailing edge sensor, a panel leading edge sensor and a panel trailing edge sensor, said riser leading edge sensor being positioned for sensing the leading edge of a right riser, said panel leading edge sensor for sensing the leading edge of a right panel, said riser trailing edge sensor for sensing the trailing edge of a left riser, said panel trailing edge sensor for sensing the trailing edge of a left panel, said control system utilizing said riser and panel leading edge sensors and said riser and panel trailing edge sensors to align a left riser with a left panel and a right riser with a right panel, respectively.

15. The automated sewing system of claim 14 wherein said loading unit operates in an alternating manner such that said leading edge sensors are activated and a right riser and a right panel are loaded in said loading unit for alignment, upon alignment and advancement to said seam folding unit said trailing edge sensors are activated and a left riser and left panel are loaded in said loading unit for alignment.

16. The automated sewing system of claim 11 wherein said second conveying assembly includes a folding unit riser conveying belt assembly and a folding unit panel conveying belt assembly, the speed of rotation of said folding unit riser conveying belt assembly being controlled via a folding unit riser motor, the speed of rotation of said folding unit panel conveying belt assembly being controlled via a folding unit panel motor, said control system including a riser motor control for offsetting the speed of rotation said folding unit riser conveying belt assembly relative to the speed of rotation of said folding unit panel conveying belt assembly such that the article fed by the folding unit riser conveying belt assembly is fed to said sewing unit at a different speed than the article fed by the folding unit panel conveying belt assembly.

17. The automated sewing system of claim 16 wherein the two articles are right and left risers to be sewn to right and left panels, respectively, to form the right and left rear portions of a pair of jeans, respectively, said control system being configured such that right risers and panels and left risers and panels are fed through said loading unit, said seam folding unit and said sewing unit in an alternating manner, said control system including a right leg/left leg switch such that the speed of rotation of said folding unit riser conveying belt assembly alternates between a speed for right legs and a speed for left legs, said right leg/left leg switch being toggled when the sewn product exits said sewing unit.

18. The automated sewing system of claim 11 wherein said sewing unit includes a sewing machine supported by said support table for sewing the two articles at the seam, said control system including a sewing sensor for controlling the operation of the sewing machine, said sewing sensor being positioned between said sewing machine and said seam folding unit, said sewing sensor sensing a leading edge of one of the articles as it exits the seam folding unit triggering the operation of said sewing machine, said sewing sensor sensing when the trailing edge of the article clears said sewing sensor thereby triggering the cease of operation of said sewing machine, said control system defining a time delay upon detection of the trailing edge of the article via said sewing sensor such that said sewing machine ceases operation after said time delay.

19. The automated sewing system of claim 18 wherein said sewing unit further includes a waste thread collector for cutting and collecting waste thread fragments, the operation of said waste thread collector being controlled by said sewing sensor, said waste thread collector including a cutter, a suction assembly and a material guide, said cutter being mounted to said support table proximate said sewing machine, said suction assembly being positioned between said cutter and said sewing machine such that a sewn article passes over said suction assembly and said cutter, said material guide being positioned above said cutter and said suction assembly such that the sewn article passes between said material guide and said cutter and said suction assembly, said material guide for forcing the sewn article and excess thread downward on said cutter, said suction device for pulling a cut piece of thread away from the sewn article.

20. The automated sewing system of claim 18 wherein said sewing unit further includes a thread break sensor mounted proximate a thread cone of said sewing machine, said thread break sensor for detecting a break in the thread.

21. An automated sewing system for sewing two articles together, said automated sewing system comprising:

a support table;

a loading unit positioned proximate the first end of said support table, said loading unit including a loading assembly for receiving the two articles, said loading unit including a first conveying assembly for clamping down on the two articles to securely maintain a relative disposition of the two articles and advancing the two articles to a seam folding unit supported on said support table;

said seam folding unit for receiving the edges of the two articles to fold a seam, said seam folding unit including a seam folder and a second conveying assembly for conveying the two articles through said seam folder and advancing the two articles to a sewing unit supported on said support table;

said sewing unit for sewing the two articles at the seam to produce a sewn product; and, a control system for monitoring and controlling said loading unit, said seam folding unit and said sewing unit, said control system including a first leading edge sensor and a second leading edge sensor positioned in said loading unit for detecting a leading edge of one article and a leading edge of the remaining article, respectively, said first and second leading edge sensors for aligning the two articles.

22. An automated sewing system for sewing two articles together, said automated sewing system comprising:

a support table;

a loading unit positioned proximate the first end of said support table, said loading unit including a loading assembly for receiving the two articles, said loading unit including a first conveying assembly for clamping down on the two articles to securely maintain a relative disposition of the two articles and advancing the two articles to a seam folding unit supported on said support table;

said seam folding unit for receiving the edges of the two articles to fold a seam, said seam folding unit including a seam folder and a second conveying assembly for conveying the two articles through said seam folder and advancing the two articles to a sewing unit supported on said support table;

said sewing unit for sewing the two articles at the seam to produce a sewn product; and, a control system for monitoring and controlling said loading unit, said seam folding unit and said sewing unit, said control system including a first trailing edge sensor and a second trailing edge sensor positioned in said loading unit for detecting a trailing edge of one article and a trailing edge of the remaining article, respectively, said first and second trailing edge sensors for aligning the two articles.

23. An automated sewing system for sewing two articles together, said automated sewing system comprising:

a support table;

a loading unit positioned proximate the first end of said support table, said loading unit including a loading assembly for receiving the two articles, said loading unit including a first conveying assembly for clamping down on the two articles to securely maintain a relative disposition of the two articles and advancing the two articles to a seam folding unit supported on said support table;

said seam folding unit for receiving the edges of the two articles to fold a seam, said seam folding unit including a seam folder and a second conveying assembly for conveying the two articles through said seam folder and advancing the two articles to a sewing unit supported on said support table, said second conveying assembly including a first conveying belt assembly and a second conveying belt assembly, the speed of rotation of said first conveying belt assembly being controlled via a first motor, the speed of rotation of said second conveying belt assembly being controlled via a second motor;

said sewing unit for sewing the two articles at the seam to produce a sewn product; and, a control system for monitoring and controlling said loading unit, said seam folding unit and said sewing unit, said control system including a first motor control for offsetting the speed of rotation of said first conveying belt assembly relative to the speed of rotation of said second conveying belt assembly such that the article fed by said first conveying belt assembly is fed to said sewing unit at a different speed than the article fed by said second conveying belt assembly.

24. The automated sewing system of claim 23 wherein the two articles are right and left risers to be sewn to right and left panels, respectively, to form the right and left rear portions of a pair of jeans, respectively, said control system being configured such that right risers and panels and left risers and panels are fed through said loading unit, said seam folding unit and said sewing unit in an alternating manner, said control system including a right leg/left leg switch such that the speed of rotation of said first conveying belt assembly alternates between a speed for right legs and a speed for left legs, said right leg/left leg switch being toggled when the sewn product exits said sewing unit.

* * * * *